US010513365B1

(12) United States Patent
Riley

(10) Patent No.: US 10,513,365 B1
(45) Date of Patent: Dec. 24, 2019

(54) PRODUCT DISPLAY CONTAINER

(71) Applicant: Beverly Ann Riley, Paragould, AR (US)

(72) Inventor: Beverly Ann Riley, Paragould, AR (US)

( * ) Notice: Subject to any disclaimer, the term of this patent is extended or adjusted under 35 U.S.C. 154(b) by 12 days.

(21) Appl. No.: 15/476,967

(22) Filed: Mar. 31, 2017

Related U.S. Application Data

(60) Provisional application No. 62/316,500, filed on Mar. 31, 2016.

(51) Int. Cl.

| | |
|---|---|
| ***B65D 5/42*** | (2006.01) |
| ***B65D 19/12*** | (2006.01) |
| ***A47F 5/12*** | (2006.01) |
| ***A47F 5/13*** | (2006.01) |

(52) U.S. Cl.
CPC ..... *B65D 5/4204* (2013.01); *A47F 5/12* (2013.01); *A47F 5/13* (2013.01); *A47F 5/132* (2013.01); *B65D 19/12* (2013.01); *B65D 2203/00* (2013.01)

(58) Field of Classification Search
CPC ... A47F 5/12; A47F 5/13; A47F 5/132; B65D 5/42; B65D 5/4204; B65D 6/24; B65D 6/28; B65D 19/12; B65D 21/00; B65D 21/02; B65D 21/0228; B65D 43/02; B65D 2203/00
USPC ..... 220/4.26, 4.27, 23.83, 23.86–23.89
See application file for complete search history.

(56) References Cited

U.S. PATENT DOCUMENTS

| | | | | |
|---|---|---|---|---|
| 5,938,058 | A * | 8/1999 | Kim | A45C 7/005 220/4.26 |
| 7,021,480 | B2 * | 4/2006 | Yu | A47J 47/16 220/4.27 |
| 9,079,449 | B2 * | 7/2015 | Gruber | B42F 7/14 |
| 9,102,439 | B2 * | 8/2015 | Kemper | B65D 21/0228 |

(Continued)

FOREIGN PATENT DOCUMENTS

| | | | | |
|---|---|---|---|---|
| FR | 2865718 | A1 * | 8/2005 | B65D 21/0228 |
| GB | 2459142 | A * | 10/2009 | A47J 47/08 |

OTHER PUBLICATIONS

US Box Corp., Rigid Clear Round Plastic Boxes, Retrieved Mar. 2017, Online, http://www.usbox.com/Boxes/Rigid-Clear-Round-Plastic-Boxes/0LV/.

(Continued)

*Primary Examiner* — Bryon P Gehman

(57) ABSTRACT

The present invention is a multi-use, attractive, flexible and affordable gift container to pack several items into a single packaged product or gift and to display labels and photos. The present invention is adaptable because it allows its users to add compartments as needed to accommodate packing a plurality of items into one or more stackable and add-on containers for placement into a larger host vessel or as a stand-along product display arrangement. The present invention will aid consumers and retailers in packing a more efficient and creative product arrangement of gift and retail items. Thus, the present invention is adaptable for many types and sizes of items for sales promotion, gift giving and product appeal. Furthermore, the present invention reduces waste by providing its recipients with extended use for storage of many various office and household items.

9 Claims, 29 Drawing Sheets

(56) References Cited

U.S. PATENT DOCUMENTS

| | | | | |
|---|---|---|---|---|
| 2002/0130126 | A1* | 9/2002 | Rosenberg | B65D 21/083 220/4.26 |
| 2007/0012693 | A1* | 1/2007 | Kummer | B65D 43/0231 220/4.27 |
| 2014/0224757 | A1* | 8/2014 | McWhorter | B65D 21/0228 215/10 |

OTHER PUBLICATIONS

US Box Corp., FDA Approved Clear Round Tube, Retrieved Mar. 2017, Online,http://www.usbox.com/Boxes/FDA-Approved-Clear-Round-Tube/0LV/.

US Box Corp., Rigid Clear Plastic Cub Boxes, Retrieved Mar. 2017, Online, http://www.usbox.com/Boxes/Rigid-Clear-Plastic-Cube-Boxes/0LV/.

US Box Corp., Clear Can with Solid Tin Lid, Retrieved Mar. 2017, Online, http://www.usbox.com/Boxes/Clear-Can-With-Solid-Tin-Lid/0LV-thumb/.

PaperMart®, Clear Round Plastic Containers, Retrieved Mar. 2017, Online, https://www.papermart.com/clear-round-plastic-containers/id=16327.

PaperMart®, Large Clear Plastic Cylinder Containers, Retrieved Mar. 2017, Online, https://www.papermart.com/large-clear-plastic-cylinder-containers/id=16329.

Visipak®, Rigid and Flexible Bottom Containers, Retrieved Mar. 2017, Online, https://www.visipak.com/containers.html.

Amazon,Shipwreck Beads Plastic 5-Piece Large Screw Top Stackable Jars, 70 by 130 mm, Clear, 2-Pack, Retrieved Mar. 2017, Online, https://www.amazon.com/dp/B007JSBNGG/ref=olp_.

Amazon, Storage Stackable Container, Retrieved Mar. 2017, Online, https://www.amazon.com/gp/offer-listing/B007JSBNGG/ref=dp_olp_new_mbc?ie=UTF8&condition=new.

Amazon,Creative Options 1082-83 4-Stack Jar Organizer for Scrapbooking, Large, Retrieved Mar. 2017, Online, https://www.amazon.com/Creative-Options-1082-83-Organizer-Scrapbo.

HealthAssessories.com, Stackable 7-day clear organizers with lables, Retrieved Mar. 2017, Online, http://www.healthaccessories.com/pill-organizers/stackable-7-day-clear-pill.

OXO, OXO Storage Containers, Retrieved Mar. 2017, Online, https://www.oxo.com/products/storage-organization/food/10-piece-pop-container-set-white.

Felli®, Flex and Stor Storage Containers, Retrieved Mar. 2017, Online, http://www.felli.com.tw/kitchen/product_show.php?sn=309.

Target.com, Oggi 8 Piece Round Airtight Glass Canister and Spice Jar Set with Stainless Steel Lids, Retrieved Mar. 2017, Online, https://www.target.com/p/glass-cylinder-canister-set-of-4-threshold-153/-/A-14150553?lnk=rec|adaptpdph1|related_prods_vv|adaptpdph1|14150553|0.

* cited by examiner

PRODUCT DISPLAY CONTAINER

CROSS REFERENCE TO RELATED APPLICATIONS

Provisional Patent Application Number 62/315,00, Filed Mar. 31, 2016

FEDERALLY SPONSORED RESEARCH

None

SEQUENCE LISTING

None

BACKGROUND OF THE INVENTION

The present invention relates generally to merchandise, gift, and food containers. Specifically, containers used to pack a plurality of items and to display, literate, photos, labels, merchandise and decorative items inside, around, or above said containers. Retailers, distributors, and consumers use various types of containers to pack and display food or merchandise to for sells, promotions and gifts, respectively. Moreover, numerous retailers, manufacturers and distributors use containers to sell multiple items as single purchase. Examples of single purchase products include Easter baskets, food baskets and retail collections of candy, coffee, food, toys and numerous other products. Similarly, consumers use containers to pack several items into a single gift package or container. Furthermore, consumers pack and/or wrap their own gifts using numerous types of packaging aids such as boxes, gift bags, baskets, tins, buckets, mugs, and other fillable containers. Unfortunately, many consumers who pack their own gifts experience difficulty wrapping and packing different sized items into a single, economical, attractive and reusable container. The present invention is a solution to these challenges for the everyday do-it-yourself (DIY) consumer in addition as well as retailers, manufacturers and distributors.

Likewise, restaurants use containers for take-out and to-go orders. The present invention is adaptable for use as a food separator for consumers who prefer their food items packed separately. Many restaurants pack food orders in a single take-out container without dividers; unfortunately, the food packed in some of these containers spill onto other food items during travel. In some cases, food items or juices dampen foods inside the to-go container such as bread and fried foods; consequently, when foods spill or move during transport onto other foods in a take-out container, it distorts the original the taste of the food. For some consumers, this is very disappointing. The present invention remedies this problem by providing restaurants with an alternative to separate food items in an attractive and uncompromising way to preserve food tastes and satisfy consumers.

The idea for the present invention was conceived when the inventor desired to pack various items into a gift arrangement similar to the Easter basket to give away on Easter. To elaborate, the inventor wanted to make a gift using a mug instead of a basket and pack large and small items in, around, or above the mug. The collection of items included any one or more of a cross, egg, bible, bookmark, candy, gum, flowers, photos, Easter grass, figurine, candle, key ring, brochure, books and other religious items. The challenge of packing said collection was structure, stability and display. Structurally, some of the items the inventor desired to pack would not fit into a selected mug with a 5.75" diameter. For example, the inventor wanted to pack a leather or hardback 5.75" wide and 8.75" high bible into the mug; even though the book did not fit into said mug, the book was placeable above the mug. However, the inventor discovered that the same sized rolled or bent paperback could fit into a mug, but this solution caused additional complications. The problem with rolling or bending a paperback book to fit inside or around the sides of the mug is that bending or rolling the book caused the book to curl. Subsequently, after removal of said paperback book, the book would not flatten anymore. Furthermore, rolling up the book for placement inside the mug compromised the display of the book's cover, consumed too much of the mug's capacity, and limited the addition of other items.

Consequently, placing books, eggs, candy, and other items in a mug creates a stability problem for packing because packed items move, fall, limit capacity and obstruct visibility of all of the items when packing more than a few item. After encountering difficulty packing the items in a mug, the inventor decided to stack items in a container that was placeable into the mug for added visibility, increased capacity and appeal.

Moreover, some items the inventor wanted to pack were larger than the mug; however, the inventor believed that containers suitable for inclusion of a mug; the inventor needed a container that accommodated the separation and display of the large or small items such as large bible. The inventor expected to find a container in the market place to solve this packing and display problem. The containers observed in stores and on the internet did not have the sizes, heights, widths and other features the inventor wanted which was a container that was affordable, sturdy, stackable, reusable, clear, connectible and easy to wrap or unwrap without difficulty. Out of disappointment and frustration, the inventor came up with a way to stack and display a series of connecting and compartment containers to achieve her gift arrangement expectations.

To overcome these challenges, the present invention is a stackable, yet stable, clear display container for packing and displaying various items into one easily packed unit. In addition, the present invention is placeable above a separate host container or vessel such as a basket, mug, cup, bowl or pail. Thus, the present invention is a product display container comprising one or more connection cavities and containers to increase capacity and add visibility for packing and displaying items attractively and securely. Said connector cavity provides stability, connectivity and is placeable on top of a separate container or vessel if desired. Thus, the present invention and/or a separate container or vessel is a stable product display container that accommodates the packing and packaging of a plurality of items with enhanced visibility. Furthermore, the present invention wraps easily with clear gift paper or a gift bag and adds shelf appeal and enhanced product display. Alternatively, decorating the present invention using various types of gift, display or craft aids is an added advantage because of its stable, clear, and connecting attributes. Thus, the present invention resolves the challenges encountered by inventor.

Although, there are numerous containers in the market place to pack a variety of items into one container; for the everyday consumer or small retailer, there are several disadvantages associated with acquiring and using suitable gift and display containers. Disadvantages include costs, value, functionality, and future use. From an economic standpoint, a single gift container may not be available for purchase because many manufacturers, distributors and suppliers require minimum order quantities. Thus, the everyday consumer must purchase more than one of a particular container. Minimum order quantities increase the overall costs for DIY consumers who want to buy just few different sized containers. Another added cost is shipping, as many gift containers are only available on-line with additional charges for shipping and handling. In some cases, shipping is free, but free shipping usually comes at another price such as minimum purchase requirement or longer delivery times.

Another disadvantage to containers purchased in the market place for gift or retail collections is value. Although, many containers are abundantly available for the DIY consumer at the local retail store such as straw and wire baskets, pails, buckets, storage containers, boxes and tins; many of the containers are disposable by design. To discuss a few, some straw baskets unravel or lose their shape. Some tins retain smells from the contents or rust when washed. Plastic container lids lose their shape or break during use as with certain product, food or candy containers with temporary use lids or display covers. Likewise, handles on pails break or fall off. Thus, many consumers discard gift, retail and food containers after content removal. Today and historically, some Easter baskets are packaged using cardboard inserts to tie and secure the items and for display; unfortunately, removing the items from the cardboard can be difficult and disappointing for children. Moreover, certain Easter baskets unravel, warp, or fade; for this reason, these abundant poorly made baskets weren't selected for use in the desired gift arrangement. Subsequently, the cardboard and the many holiday baskets end up in the trash thereby contributing to more waste. By design, many gift containers are disposable. Said disposable containers include paper gift bags and boxes, apparel containers, straw and wire baskets, various tins and pails, and plastic containers of all shapes and sizes. The handles on gift bags break or the bags tear. Thus, temporary use of said packaging aids contributes to waste if not recycled. The containers of the present invention are reusable in numerous ways once empty.

One more disadvantage of packing containers in the market is future or extended use. Many consumers discard gift containers or packaging once empty. The present invention can provide the consumer with several extended use options. One use for the present invention is the display of photos. Another use for the present invention is the use of removable compartments to store household, personal items or office supplies. Similarly, consumers can reuse the container of the present invention to pack another gift. Thus, the present invention is reusable in a several ways to minimize waste and provide extended use for the consumer.

Other disadvantages of gift or retail containers sold in the market place include limited value and functionality. To conclude, a number of gift containers available in the market place for the DIY consumer were insufficient for the gift arrangement desired by the inventor. As previously pointed out, the inventor desired containers with features that were connectible, easily removable and packable as a single unit for wrapping. The ideal containers of the present invention are clear; have screw-on or press-on features to combine into a single display product arrangement placeable on top of another container or vessel or as a stand-alone product or gift. The said features allows consumers to connect containers to build a viewable product display or tower this is free standing or attachable to a mug or other sized container or vessel. Thus, the present invention is adaptable for the addition of various types and sizes of containers to show case a collection of items in a single gift or product arrangement.

The present invention utilizes one or more containers to pack and display products. The containers of present invention connect or stack. The present invention is a single host container or a set of stacked host containers for packing merchandise and hosting other containers. The present invention is also placeable above a vessel or other adequately sized containers such as mugs, baskets, pails, cups, bowls, shaped boxes or other shaped containers.

To conclude, the container of the present invention has one or more compartments to secure, display and separate items or products. However, consumers may use the present invention with or without a separate vessel or container for placement into said vessel or container. As a stand-alone product, the present invention is ideal for packing and displaying multiple items in a single container using its add-on compartment containers or add-on host containers. Said add-on compartment containers are connectible, separable and detachable to assist packers achieve numerous assembly or reassembly and storage alternatives.

BACKGROUND OF THE INVENTION—PRIOR ART

The market place has an abundance of clear shaped containers made using several types and combination of materials such as acrylic, PVC, PET, PETG, plastic, tin, cardboard and polypropylene. Surprisingly, a search for clear containers in various shapes and sizes did not reveal any containers with connectible bowl-shaped, cup-shaped or other shaped host compartment containers that also function as closures and that were attachable to each other, vessels, mugs or other containers. Many of the searched clear containers were single containers, some decorative, instead of stackable containers.

A further search for clear manufactured containers did not reveal any known containers with push-on or screw-on bowl-shaped or cuplike shaped compartments that are attachable to each other or a separate host container or vessel such as a bowl or mug. For example, an on-line vendor, PaperMart®, sells various clear gift and food containers; however, the containers on their website do not connect. Moreover, Visipak® supplies many types of cylinder tubes and various shaped containers on-line; yet, the containers supplied by Visipak® do not connect; instead, their containers have push-on and screw-on lids or caps for closure only. However, Visipak® and other suppliers or manufacturers provide cylinders with threaded ends; unfortunately, the cylinders had size limitations that were inadequate for the present invention.

Another on-line store, HealthAccessories.com does supply a very small version of a connecting screw-on pill organizer; unfortunately, the size of the organizer and its add-on containers are too small for use with the present invention. The pill organizer has several small screw-on cylinders without a host container, and the design and use of the pill organizer is not for large items such as books, eggs or bookmarks. Yet, a larger version of the pill organizer is relevant; unfortunately, a larger sized model of a pill organizer would require the use of a separate attachment similar to the connector compartment cavity shown in FIGS. 8 and 9 to secure the organizer to a larger host mug, vessel or container. As made, the pill organizer is too small for the present invention and requires customization. Thus, customization is a change in the product for a different use.

Likewise, Amazon® sells clear stackable and screw-on containers (2.75" diameter and 1" high) with lids that are larger then said pill organizers; yet, these containers do not have a surrounding host container nor are the containers available in sizes suitable for the present invention to separate and display larger items such as a mug inside a the host container. Moreover, said containers offered by Amazon® also require customization.

Regarding other containers with push-on and add-on capability, U.S. Box Corp. (USBC) supplies different sized and shaped containers that have push and lock snap in top and bottom closures; however, a connector is needed to connect USBC's said container to their container or any other host container, vessel or mug. Thus, USBC's containers are not connectible or stackable.

After observing the previously searched containers and many other similar containers in the market place and on-line, the containers observed had limitations in size and adaptability to meet the said use of the present invention. For instance, none of the containers observed incorporated connecting bowls or cup-like shaped containers that fit on top of a mug or other host container without the use of a connector to build a stable gift or display unit for enclosure and separation of large or small items.

Furthermore, many clear containers in the market place have width or height limitations. The packaging retailers and distributors do sell larger clear containers for packing items such as ornaments, candy, popcorn, cookies, nuts and dry goods; yet, suppliers of said larger clear containers serve markets that sell bulk quantities of a single or few items in one container. In order to find a wider and taller clear container, the market place offers various taller and wider clear, stackable storage containers. There are several types of clear containers sold under the brand names OXO®, OGGI™ and Felli® that do not connect by screw-on or push-on features. Moreover, said container brands are sturdy, clear, hard plastic or acrylic storage containers; unfortunately, the containers sold under said brand names cost more because consumers purchase the containers for long-term use. Consequently, the large storage containers sold under these brand names lack the specifications desired by the inventor for connectivity, affordability, and functionality for a gift arrangement or product display.

A patent search revealed a few containers that may be relevant to the present invention because of certain characteristics; however, no specific patent or application observed contained every feature of the present invention. Consideration was given to Lucille Watts' U.S. Pat. No. 5,020,672 because Watts patent provides a solution for the containment of grass in an Easter or holiday basket; unfortunately, Watts patent and the references cited by Watts do not relate to the present invention. Several other patents obtained by Rubbermaid® for storage containers were found; yet, Rubbermaid's° patents and the cited references in their patent for storage containers are solutions for food storage and preservation instead of merchandise containment and display. Patent, U.S. Pat. No. D649,477S invented by Burns does include the ornamental design for a gift basket kit; unfortunately, Burns patent does not provide for compartments or connectible containers placeable into other containers or vessels. To conclude, an extensive search of patents for gift, storage, food and merchandise display containers did not reveal any patents similar to the present invention.

BACKGROUND OF INVENTION—OBJECTS AND ADVANTAGES

Accordingly, several objects and advantages of the present invention include size, shape stability, utility, appearance, adaptability and economy.

A major object and advantage of the present invention is the size. The present invention will provide its packer with a host container that is placeable on top of, inside, or around a mug or other host container or vessel. Said host container is connectible to another host container for packing and displaying additional products as shown in FIG. 9. Sample items that can be packed into the host compartment container may include, but not limited to, books, candy, jewelry, shredded gift paper or grass and other short or tall items. This feature also allows the items placed around and inside the mug or other type host container to be visible yet stable as shown in FIG. 11. Alternatively, the use of a larger container or vessel such as a pail, basket, bucket or box with an appropriately sized host container of the present invention to pack and display a plurality different sized items.

A key object of the present invention is stability. The present invention is stable because the host containers align with or connect to other containers in a tower like structure as shown in FIGS. 9, 10, 11, 12, 14, 16 and 21. After assembly and arrangement of hosts containers, compartment containers, and/or host vessels or containers, the present invention is a single stable unit for wrapping or packing. Additionally, insertion and removal of containers and their contents is less difficult if another arrangement is subsequently preferred. Instead of having to unpack each item from one hollow container, one or more containers can be removed as needed to achieve timely rearrangement or repacking. One major challenge and disadvantage of packing items into a container such as a mug, basket, pail, or other shaped container is the symmetrical arrangement of the containers or items for enhanced display, attractiveness, arrangement, and packaging. Thus, the present invention is a collection of containers forming a stable single unit for the packing, wrapping, and unpacking process.

Another object of the present invention's is to provide a removable host container in several shapes or sizes such as a square, cross, heart, star, triangle, polygon, oval, or circle for packing various types of items or food. The width and height of the present invention is customizable to meet the packing of various small or large items in a single gift or product arrangement as shown in FIGS. 14, 16, 17 and 25.

It is another object of the present invention to provide add-on and closure compartment containers in various shapes to form a usable storage container in the shape of a bowl (circle or oval) or tray such as a triangle, square, jewel, heart, polygon, octagon, star, rectangle or cross. The compartment closure cavities with add-ons compartment capability of the present invention will provide its user with numerous opportunities to build an attractive gift or retail package to accommodate their gift or retail packaging needs as shown in FIGS. 6, 7, 8, 12, 14, and 22.

Another object of the present invention is to provide the final consumer with a container or containers that are useful when emptied or removed from inside a host mug or other container for storage or display of numerous types of items. The present invention can set outside of its host container or vessel and provide its user with the added benefit of a functional container to store several other items as desired on a desktop. Once empty, the present invention can be used to display photos, store paper clips, keys, or other small items in the office or home. Additionally, the present invention is suitable for storage of multiple items in its different closure compartments within or outside a host container when utilizing removable compartment containers as shown in FIGS. 6, 10, 12, 13 and 16.

An additional object of the present invention is to provide its user with an alternative to pack and display items or photos inside the container for viewing. Since the present invention is a clear or see-through container as shown in the majority of the figures presented, most of the items inside the host and compartment containers are visible. For example, when using the present invention to pack Easter eggs or a small book, these packed items are easily observable as shown in FIGS. 9,11, 12 and 15.

Another object of the present invention is adaptability. The size, shape and height of the present invention is easier to wrap or decorate inside or outside of a mug or shaped host container using clear gift-wrap or simply a bow. For illustration, removable containers can be placed inside a host container to form separate compartments for packing items of various sizes inside a single host container as shown in FIG. 14. Further, the size of the host container can vary to accommodate different types and sizes of gift or retail items. Moreover, the present invention can host large items inside it using separate compartment containers as shown in FIGS. 10, 12, 14, and 16.

It is another object of the present invention to accommodate the use of one or more screw-on or push-in closure compartment containers to close the host container of the present invention. The present invention provides its user with several alternative ways of securing its contents. The compartment containers of the present invention have screw-on or push-in openings and bases. Thus, the compartment containers of the present invention are compartments that are closeable and connectible to form individual containers or for use as a closure for its host container. Said compartment containers connect using male or female rims that screw on or push in as shown in FIGS. 8, 11, 13, 14 and 22. FIG. 13 shows a compartment container with screw-on capability (22 and 21) and FIG. 22 depicts a compartment container with a push-in feature (33 and 34).

A further object and advantage of the present invention is its add-on capability using removable compartment containers for placement inside a host compartment container. With screw-on or push-in compartment containers, the packer can add additional compartments at the top or bottom of the removable compartment containers of the present invention. The connecting compartment containers provide packers with the ability to add one or more compartments for placement inside the host compartment container. Thus, the add-on capability of the present inventions allows its user to separate and add multiple items to enhance display of the items inside the host compartment container as shown in FIGS. 11, 12, 13, 14 and 22.

It is yet another object of the present invention for the host container of the present invention to stack using a closure and connector cavity, referred to as a compartment connector cavity. Instead of inserting various sized smaller compartment containers into a single host container, one or more host containers can be stacked. Said stackable host containers are also removable and separable as shown in FIG. 4. The connector cavity is a closure and base to build a host container using formed sheet material as shown in FIGS. 7, 18 and 20. However, said connector cavity is also a vessel for insertion of a host container to connect two or more open top, closed bottom host containers or to connect two or more opened ended shaped container shells or cylinders as shown in FIGS. 4, 5, 6, 7 and 19. Thus, the connector cavity is the base and closure for a host container to connect additional host containers and may be used as a closure to as well as shown in FIG. 3.

An additional object of the present invention is to provide a closure and connector cavity to stack two or more host containers or to build a host container. Said connector cavity is a shaped base with double walls extending above the said base. The said bases are connected to form a top and bottom cavity by screw at the center of each connector cavity base as shown in FIG. 4. The said cavity walls have an opening between the walls to form an opening for insertion of formed sheet material or a shaped host container or vessel. To construct the host compartment container, insert one or more formed material sheets between the double walls to form a container in the shape of the base. Two sets of formed material sheets inserted into opening of said cavity walls form a double walled container to provide a separate display section for inserting photos, labels or literature around the formed host container as shown in FIG. 18.

Another advantage of building the host container is that the size and height of the host container can accommodate large, small, short or tall items. For visibility, the user of the present invention can add host containers as needed and stack the containers into a stable, single product arrangement for display.

It is still another object of the present invention to provide an affordable packaging alternative for mass use by retailers and restaurants or single, one-time, or multiple uses for DIY consumers. Consumers can build their own containers using a variety of options to add additional compartments to package a single gift. Likewise, retailers can pack several related products or food items separately, economically, and attractively in one container. For example, a restaurant can pack products such as a main dish, appetizer, side item and condiments in a single container to appeal to its customers. Furthermore, a restaurant or retailer can package chips, dip and a meat or alternatively, vegetables, rice and a meat into one container and place the entire removable compartment container into a bowl, plate, or cup for consumption. Many take-out food consumers dislike having their food combined inside a Styrofoam container because the contents tend to spill onto the other food items. The present invention solves this problem as well. The present invention provides any user with more flexibility to package and display products or gift items. Thus, the size of the host compartment container of the present invention is ideal for numerous product variations or food combinations as shown in FIG. 21 at a reasonable price.

It is a further object of the present invention to provide consumers with an assembly type container or a fully assembled container with add-on capability for packing, wrapping and packaging products as a single gift or retail product as shown in FIGS. 9, 12, 15 and 17. Self-assembly alternatives to build a host compartment container will provide consumers, distributors, or retailers added flexibility to design multiple types of attractive gift and product collections.

It is yet another object and advantage of the present invention to provide consumers the ability to purchase a partially assembled host compartment container with one or more compartment containers and attach the compartment containers themselves. The present invention can be assembled with a formed host compartment container shell or material sheets and one or more compartment containers or compartment connector cavities. The material of the present invention for partial assembly is made of anyone or more of hard plastics, poly, glass, or other shapeable materials in the market including but not limited to acrylic, PVC, PET, PETG, plastic, tin, cardboard and polypropylene. This alternative assembly only requires attachment or placement of the compartment containers or compartment connector cavities the base or opening of one or more host compartment container. The purchaser may add additional compartment containers as desired. The compartment containers of the present invention are attachable by either screwing on the compartment containers to a host container shell or pushing in the compartment containers onto one or both ends of a host container shell as shown in FIG. 11, 13, 14 or 22.

It is still another object of the present invention to provide its user with the ability to select from a variety of styles, sizes and transparent colors to build an attractive and affordable gift container or product display arrangement. Gift containers can be one color, clear, or multicolored available in various sizes to fit into numerous types of host containers such as mugs, pails, buckets, baskets, bowls and boxes of all shapes and sizes.

To conclude, the objects and advantage of the present invention provide numerous opportunities to pack and display merchandise or food thereby providing consumers with visibility, flexibility, stability, usefulness and affordability.

DETAILED DESCRIPTION OF THE INVENTION—PREFERRED EMBODIMENTS

FIG. 2 is a perspective front-side view of a removable or stand-alone host compartment container in one of its simplest form in accordance with the present invention. The present invention comprises one or more, shaped or formed host containers, host compartment containers, and compartment connector cavities. The present invention of FIG. 2 is comprised of one host compartment container (2), three compartment connector cavities (39) and a mug, host vessel. To assembly the present invention shown in FIG. 2, connect two compartment connector cavities (39) by inserting a screw or plug into aligned center holes (45) as shown in FIG. 4. Next, connect the joined compartment connector cavities to the host mug by inserting the exterior rim or wall of the said mug or host vessel into the interior opening of said compartment connector cavity (39) to sandwich the walls of the mug, host vessel between the opening of one end of said compartment connector cavity (39). After attachment of said compartment connector cavity (39) to the mug, host vessel, insert a shaped host compartment container into the exposed open cavity of the compartment connector cavity (39) as shown in FIG. 2 and FIG. 5A. Lastly, insert the exposed outer rim of the inserted shaped host compartment container (4) to close the present invention as shown in FIG. 2.

Alternatively, an open ended and threaded host compartment container (7) may be substituted in place of a closed bottom shaped host container (4). This assembly requires the use of a compartment connector cavity (39) with a threaded interior wall to attach the said threaded host compartment container (7) to a threaded compartment connector cavity (39) as shown in FIG. 5.

Alternatively, a formed host compartment container shell (5) can be used to sandwich said formed host compartment container edge or rim between the opening (42) of a shaped connector cavity (39) in the same manner as the described to attach said mug as depicted in FIG. 2 and shown in FIG. 18.

To allow for insertion of a photo, bookmark, label or literature, a slightly smaller and separate formed shaped host container shell (5) is inserted on the inside of said any of the two said host compartment containers 4 or 7 and a host compartment container shell (5). The small gap created by insertion of a separate formed hosted container shell (5) can subsequently be used to insert photos, bookmarks, labels, or literature.

The said host compartment containers 4 and 7 may be in the shape of a cylinder, oval, heart, polygon, triangle, square, star, cross, jewel or rectangle as shown in FIGS. 3, 6, 7 and 22. One or both outer edges or rims (1) of said the host containers 4 or 7 are smooth or threaded, screw-in edges or rims.

Also, the host container used in the present invention may be sealed or open-ended as shown in FIG. 2, 3, 5A, 6, 7, 8, 9, 18, 19, 25, or 26. The push-in or screw-on host compartment container (2) and said shaped compartment cavities may be any one of a bowl-type, cup-type or cavity in the shape of a circle, heart, square, octagon, oval, heart, polygon, triangle, square, star, cross or rectangle as shown in the drawing figures for the present invention. Furthermore, said compartment connector cavities may be connected or used separately for insertion of a separate compartment container or vessel (4 or 7) or a formed host container shell using material sheets as shown in FIG. 29 and FIGS. 7, 9, 16, 20, 24, and 28.

Additionally, the shape of said compartment connector cavities (39) of the present invention shown in FIGS. 3, 4, 5, 6, 7, 8, 9, 18, 19, 21, 24 and 25 may host in its interior or wall openings any one or more compartment containers (2) or compartment container shells by insertion or attachment using said containers (2) push-in or screw-in features or insertion of formed compartment shells (5). Moreover, said compartment connector cavities are insertable or placeable into other container vessels such as a shaped to add appeal or décor to the present invention. Thus, the components of the present invention can be used to build numerous types of product display arrangements to satisfy consumer tastes and retail sales promotion design and packaging.

One method of making the present invention is to first select a shaped host compartment container (4 or 7) made as desired of acrylic, PVC, PET, PETG, plastic, tin, cardboard, polypropylene or other shaped material for use, connect two compartment connector cavities (39) by inserting a screw or plug into aligned center holes (45) as shown in FIG. 4. Next, connect the joined compartment connector cavities to the host mug by inserting the exterior rim or wall of the said mug or host vessel into the interior opening of said compartment connector cavity (39) to sandwich the walls of the mug, host vessel between the opening of one end of said compartment connector cavity (39). After attachment of said compartment connector cavity (39) to the mug, host vessel, insert a shaped host compartment container into the exposed open cavity of the compartment connector cavity (39) as shown in FIG. 2 and FIG. 5A. Lastly, insert the exposed outer rim of the inserted shaped host compartment container (4) to close the present invention as shown in FIG. 2. Add containers, shells or connectors as needed to enhance display or increase capacity as needed. The present invention is usable as stand-alone product display container or placed inside other types of container vessels.

The present invention having been described with particular reference to the preferred forms thereof; it will be obvious that various changes and modifications may be made without departing from the spirit and scope of the invention as defined herein.

Operation of the Invention

To operate or use the present invention, the user must simply unscrew or pull up on the compartment container (2), connector compartment cavity (39), or host container (4 or 7) at the top to open the present invention. Photos, books and other bendable items can be placed around the sides of the inside of said host container or container shell walls. Unscrew or pull up on connected components of each compartment or formed compartment to fill with desired items. Once filled, close the present invention in the same manner opened. Wrap or decorate as desired.

Alternative Embodiments

There are various possibilities with regard to the construction of the present invention. Select one or more shapeable material sheets (30) and two or more compartment containers (2) or compartment connector cavities to build the present invention. To assemble, use the reconfigured material sheets (30) to form a shaped of cylinder, heart, square, polygon, triangle, or square, cross, star, or jewel. Either unfold material sheets into preconfigured shape or form a compartment container shell (5) by removing double-side adhesive strips from the material sheets and pressing together. Insert the open ends of the formed compartment container shell (5) or the open interior walls of a compartment connector cavity (39) or the opening folded outer lip of a shaped compartment container (2) as shown in FIGS. 7, 18, 20, and 29. Push material sheet all the way to the base of the folded lip of a selected compartment container (2) or compartment connector cavity; add adhesive as needed at said base. This step also forms a base for the then formed host container. Add another shaped material sheet to form a double walled compartment container shell for insertion of photos, labels or literature. walls selected material sheet using an enclosed or attached adhesive strip. Once the host, compartment container shape is formed, select two compartment containers (2). Use a second compartment container or compartment connector cavity (39) to close the present invention in the same manner as described form the base but do not seal opening with adhesive; tape if preferred. To add more compartments to the present invention, select additional push-in or screw in male or female compartment containers (2) and join as desired at the top or bottom of the compartment containers as shown in FIGS. 11, 14, and 22. Alternatively, additional compartment container cavities (39) may be used to addition additional capacity for items or insertion of more compartment containers for added separation and display as shown in FIG. 12. Use additional connecting compartment containers (2) or compartment connector cavities (39) as needed to achieve the desired width and height of the present invention. Insert the assembled present invention to another host vessel if preferred using additional compartment cavities (39) or simply placing the present into the other host vessel or mug as shown in FIG. 23.

To conclude, there can be many variations to the materials used to mass-produce the same result of the present invention, which is to provide a compartmental gift and display container that can fit into other containers or stand-alone. Containers can be packed and assembled from home, at an establishment, or ordered fully assembled. The available different shapes and sizes compliment numerous gift and retail packing ideas due to the present inventions adaptable and functional features. Moreover, the empty gift container is reusable for storage of many home and office items including displaying photos. Thus, the present invention offers numerous opportunities to construct and design a container that is economical and appeals to many consumer and retailers to satisfy packing and packaging needs for color, shape, size, display and usefulness.

CONCLUSION, RAMIFICATIONS, AND SCOPE

Accordingly, the reader will see that the product display container of the present invention with its removable, connectible and compartmental capability is ideal for anyone packing multiple items into a single package or gift. The present invention is a combination of multiple compartments and containers to pack items, display photos or labels and is reusable thereby helps to reduce waste from disposal of rusted, damaged, disfigured or disposable gift containers. The present invention is decorative, adaptable, and customizable in many colors and shapes to appeal to consumer taste and retail packaging and display endeavors.

DRAWINGS—FIGURES

FIG. 1 is a perspective front-view of a product display arrangement comprising a mug, two compartment connector cavities, and a compartment container for closure. The mug is connected to the product display container using the push-on feature of the compartment closure cavities interior walls.

FIG. 2 is a perspective front-view of a product display arrangement comprising a mug, two compartment connector cavities, and a compartment container for closure. The mug is connected to the product display container using the push-on feature of the compartment closure cavities interior walls. A sealed bottom host compartment container has been inserted into the interior walls of the upper compartment connector cavity. A separate compartment connector cavity is at the top of the product display for closure.

FIG. 3 depicts the use a connector compartment cavity as a closure for the host container by push-in insertion.

Figure 1:
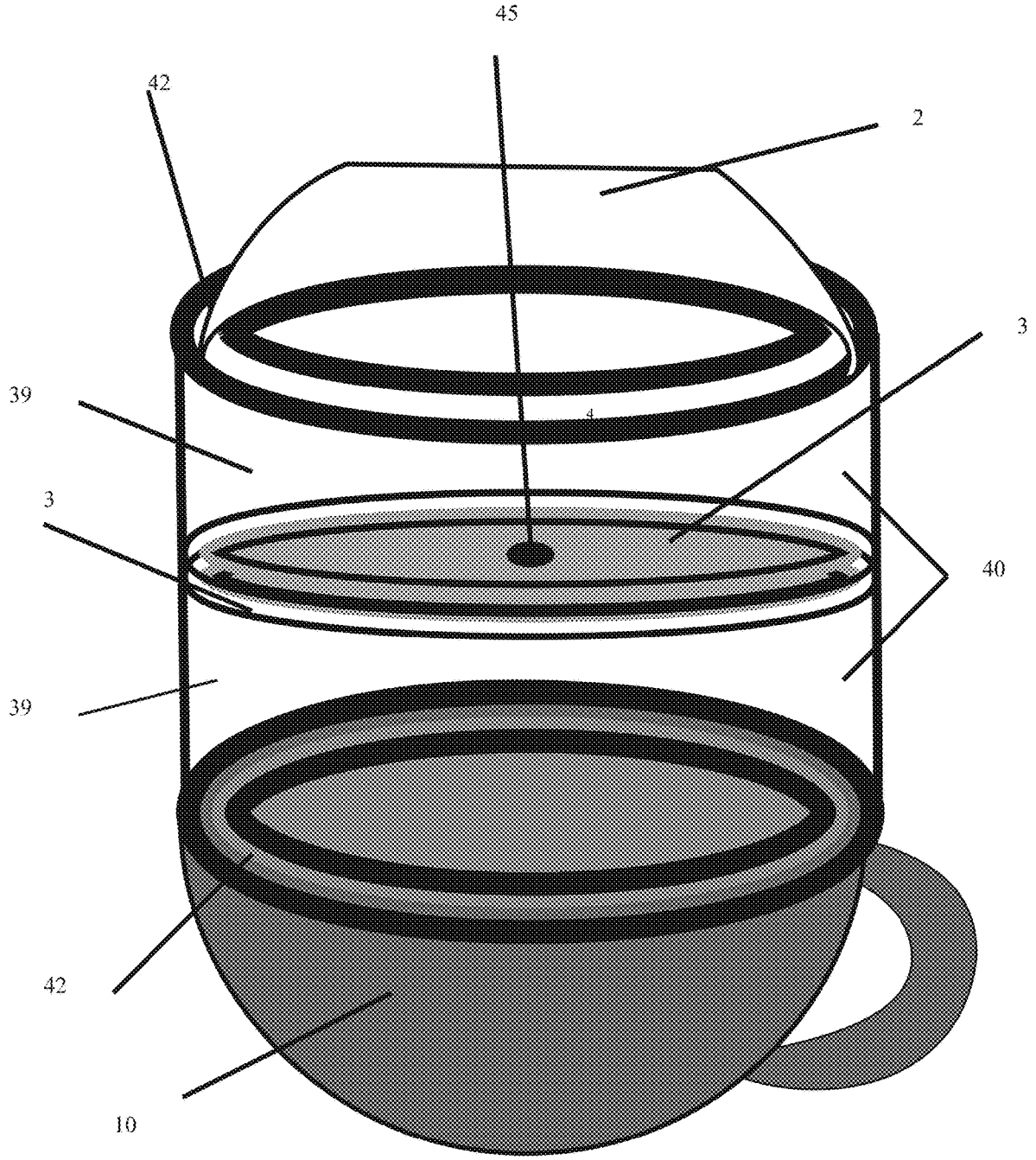
Figure 2:
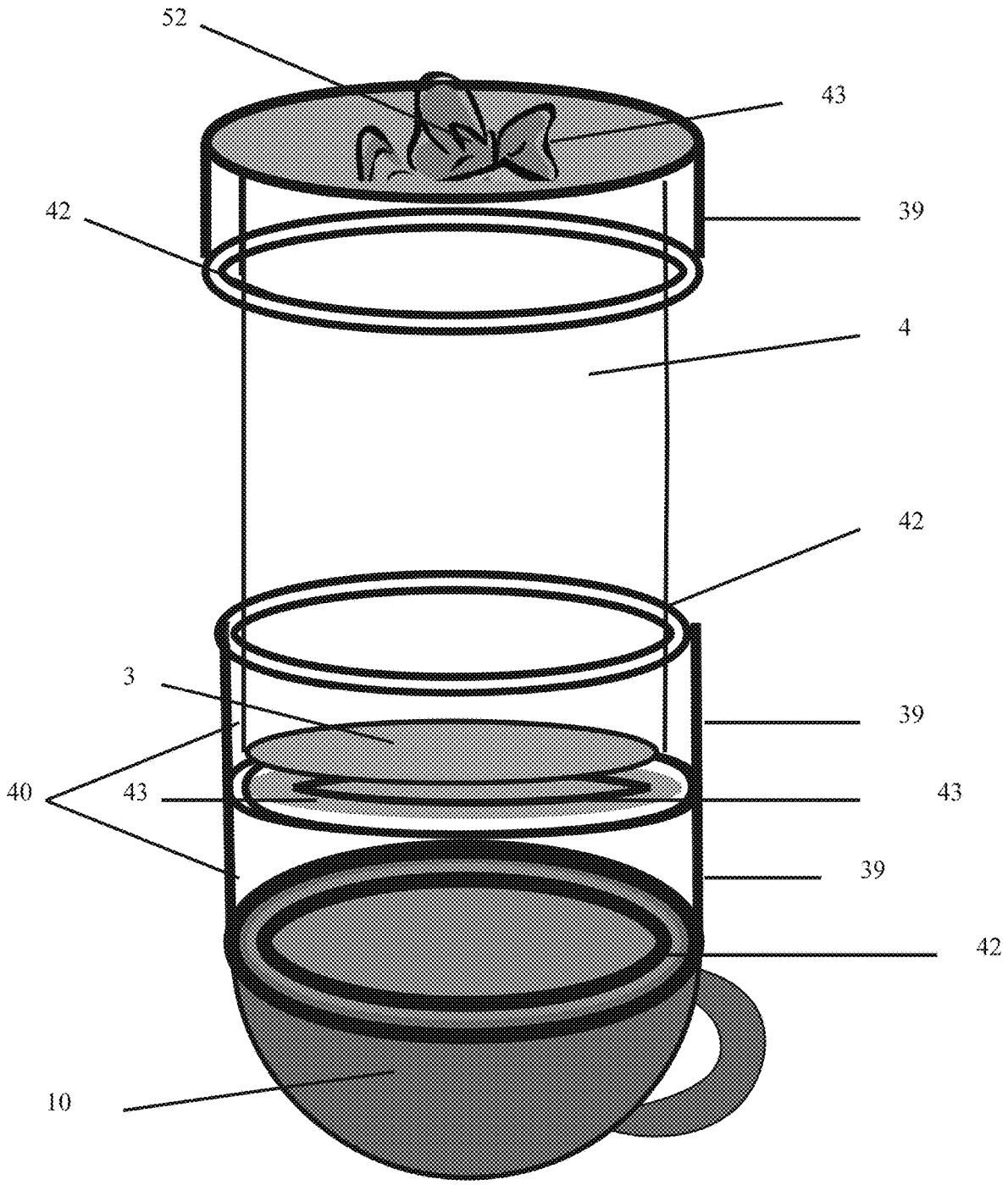
Figure 3:
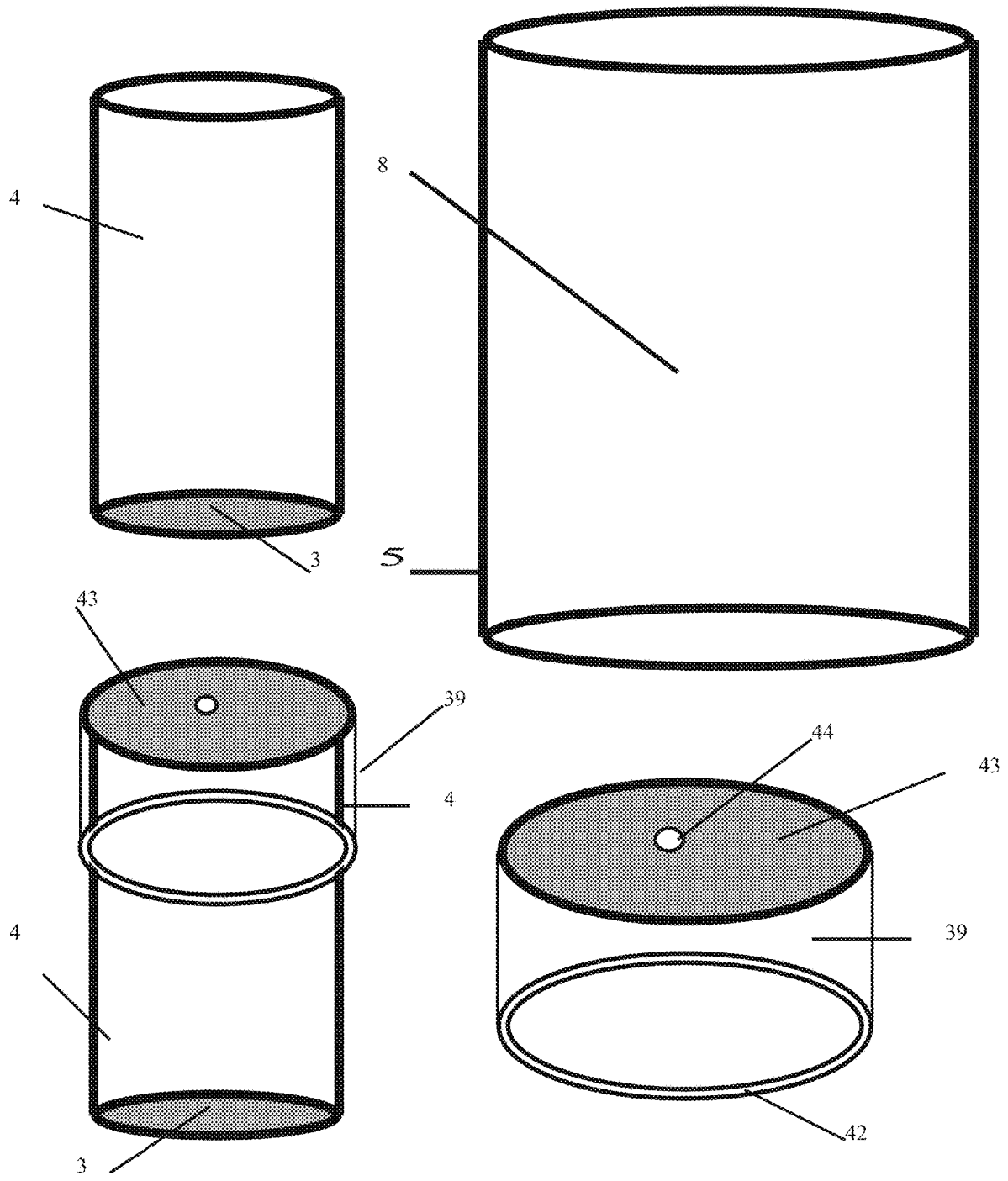
FIG. 3 is a perspective front-side view of a closed bottom host container (4), a opened ended host container shell formed with material sheets, and a connector compartment cavity.
Figure 4:
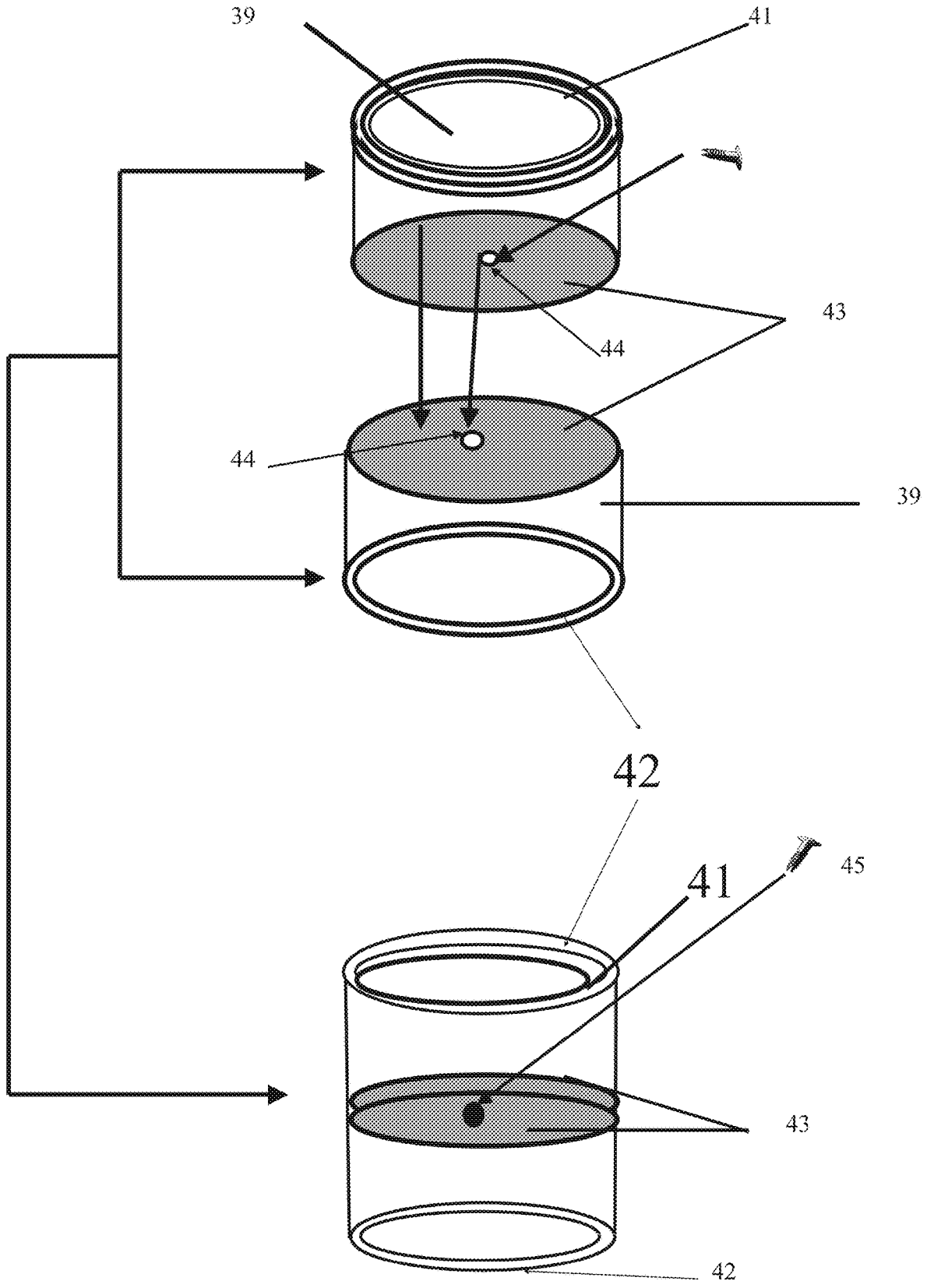
FIG. 4 is a perspective front-side view how to connect two compartment connector cavities (39) using a screw or plug to join the connectors at the center as shown below the connectors. The top compartment connector has an interior threaded wall and the bottom compartment connector has a smooth interior wall.
Figure 5:
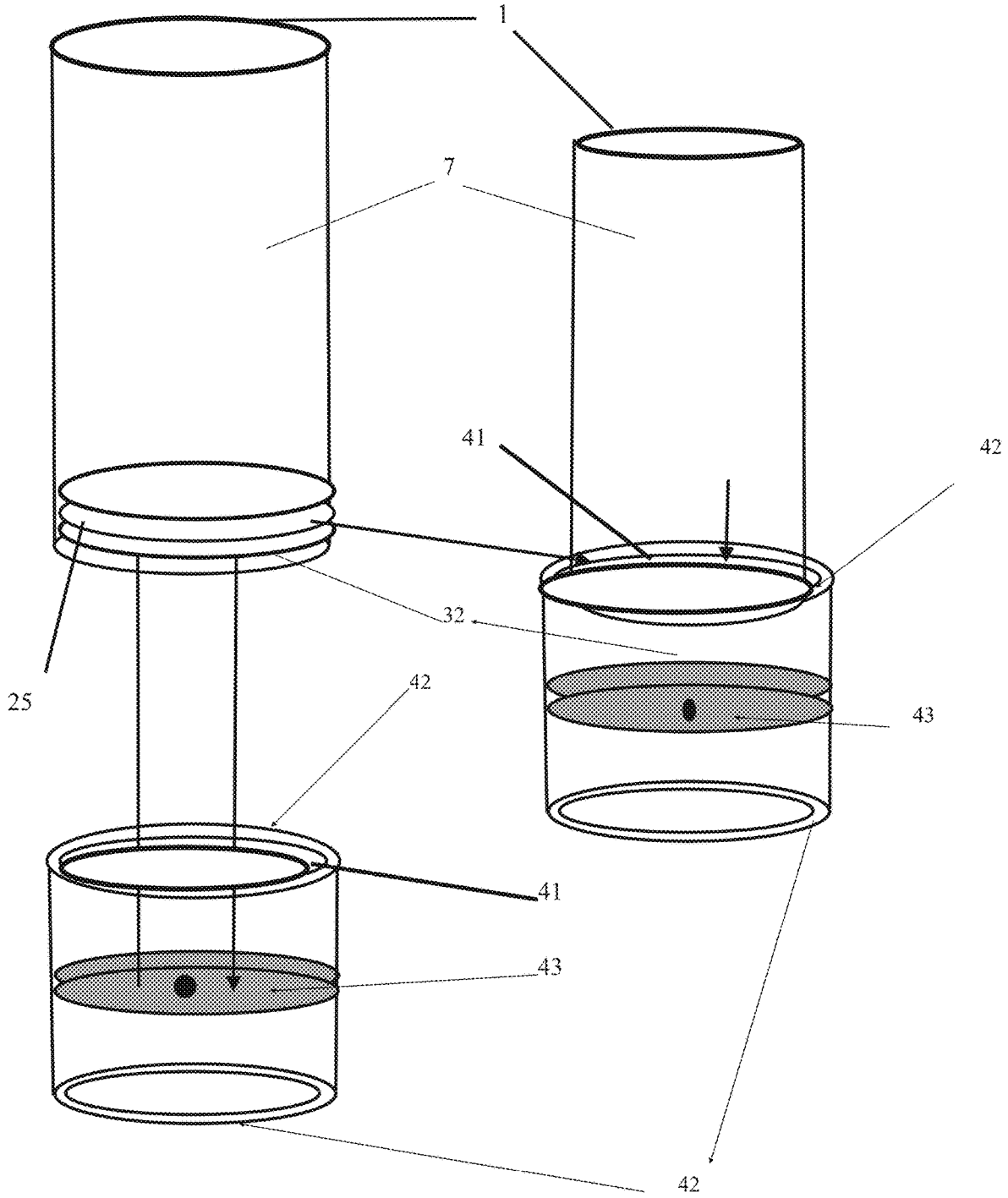
FIG. 5 is a perspective front-side view showing an alternative assembly of the present invention using a threaded host container (7) to form a taller version of the present invention using same two, compartment connector cavities described in FIG. 4.
Figure 5A:
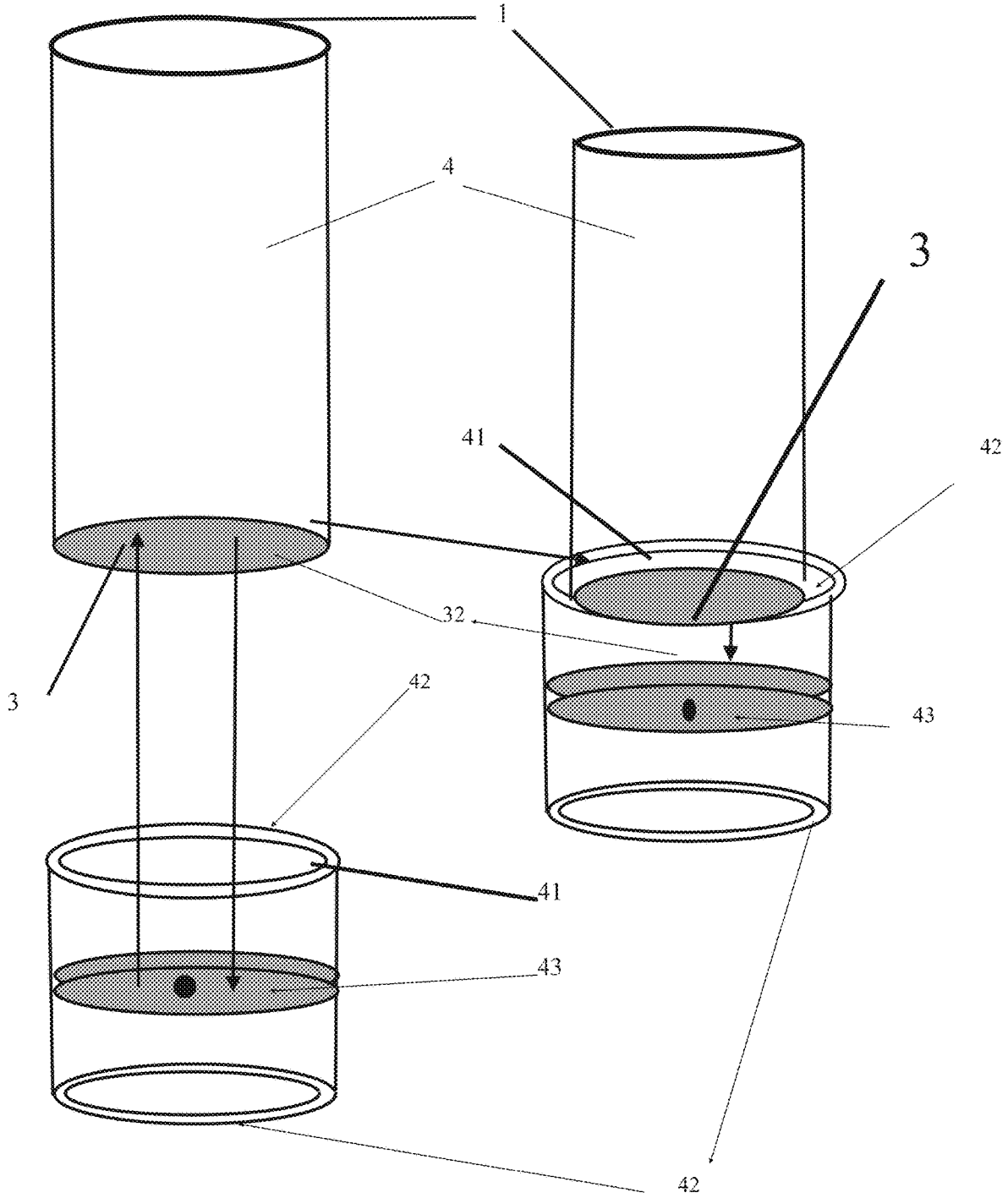
FIG. 5A is a perspective front-side view showing the present invention using two compartment connector cavities, joined by screw, and the insertion of a push in host compartment container with a sealed bottom.
Figure 6:
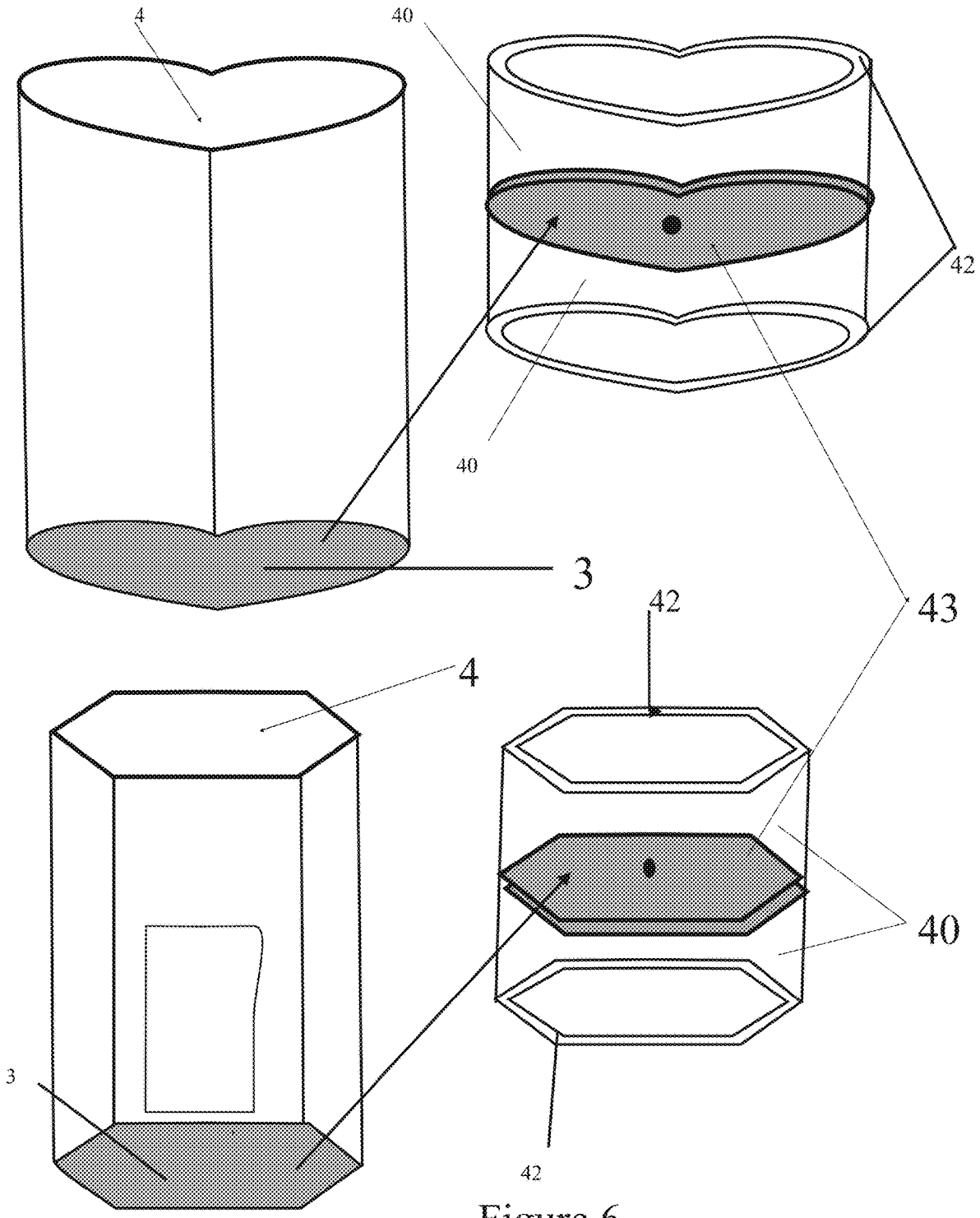
FIG. 6 is a perspective front-side view of two shaped compartment connector cavities and two shaped host compartment containers and shows how where to attached the shaped host containers using the arrows.
Figure 7:
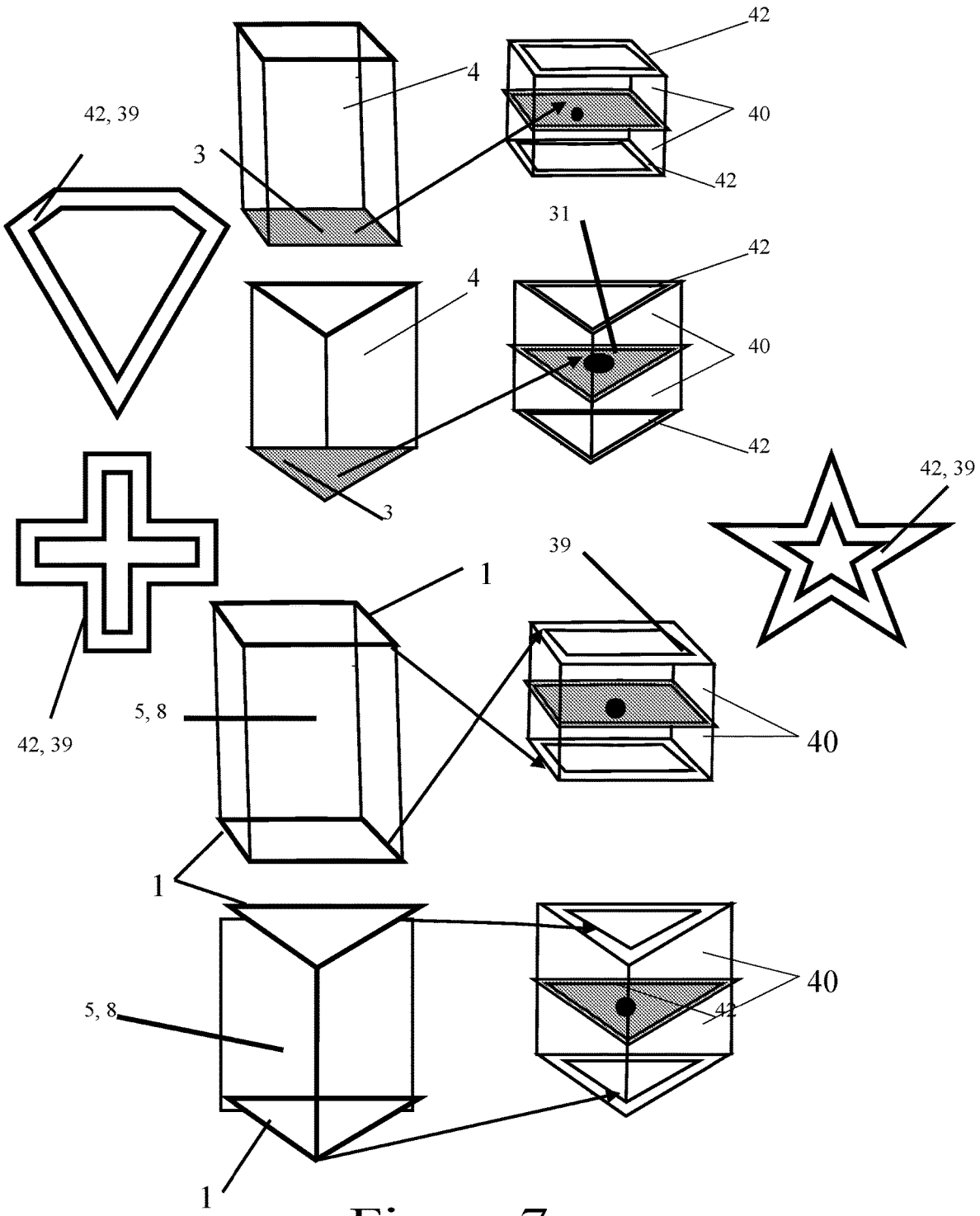

FIG. 7 is a perspective front-side view of the additional shapes of a compartment connector cavity and their insertion points. FIG. 7 also show the upper edge of other shaped compartment containers and their double walled insertion point for building the present invention for a cross, jewel and start, which may be connected in the same manner as the square and diamond connectors (2) or by adhesion.

Figure 8:
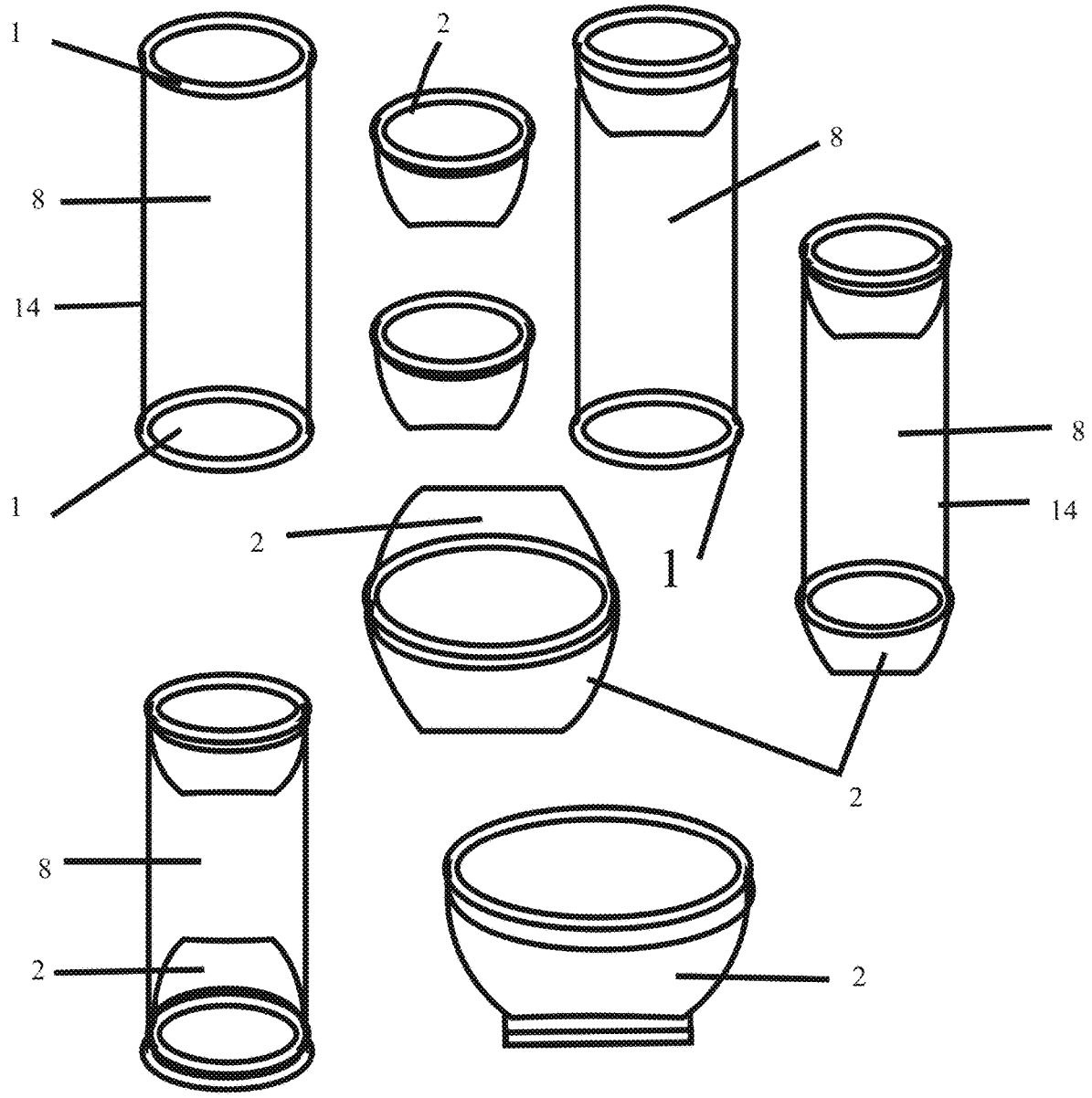

FIG. 8 is a perspective front-side view of cylinder shaped host compartments containers formed using two material sheets and their potential insertion points. The compartment containers shown have a folded lip for push in insertion of the compartment containers to connect the close the host compartment container shell at the top and the bottom.

Figure 9:
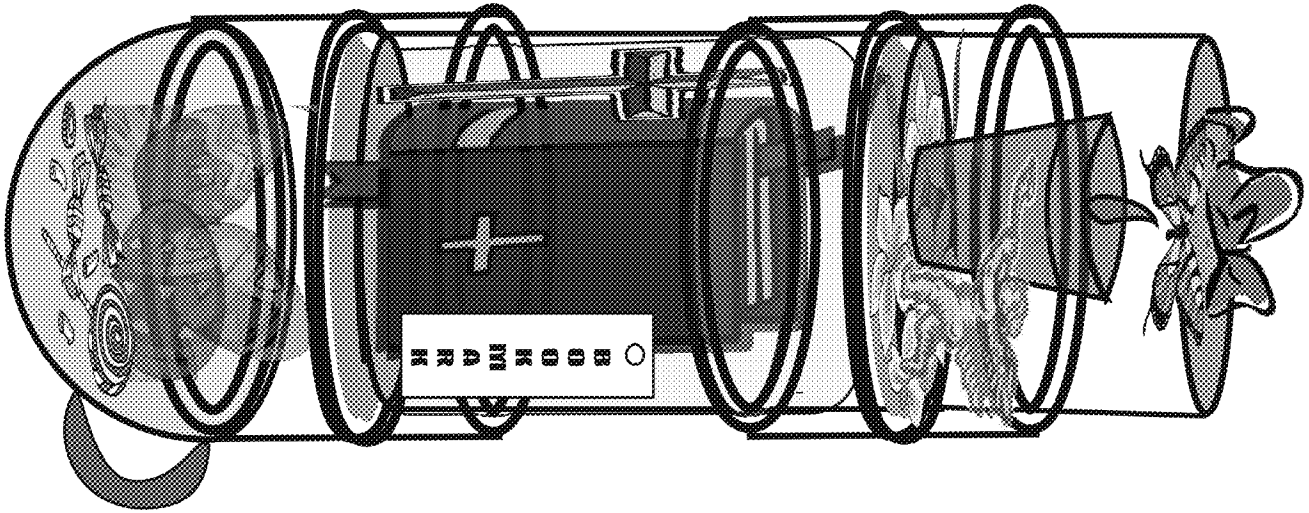

FIG. 9 is a perspective front-view of a product arrangement using the present invention.

Figure 10:
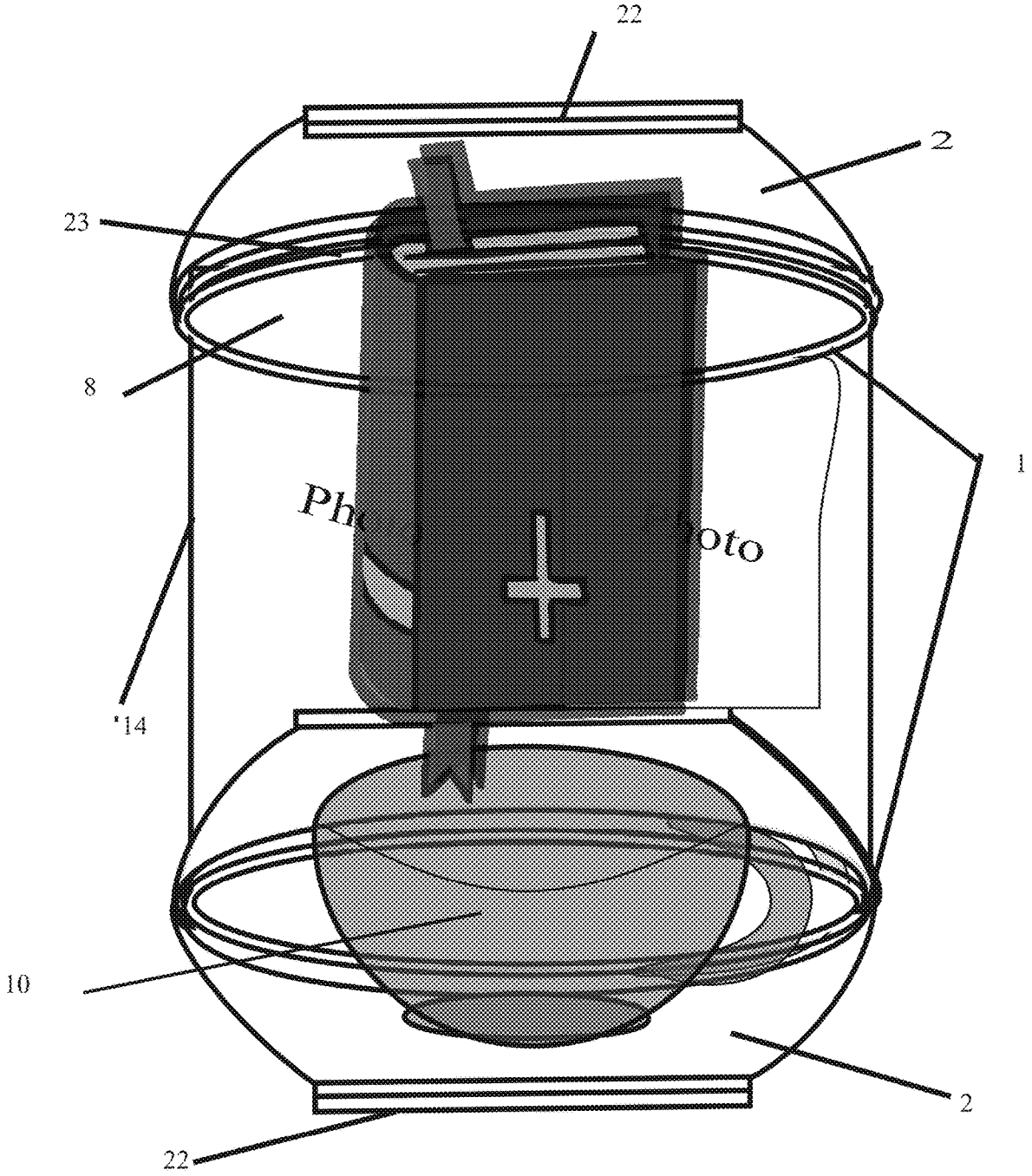
Figure 12:
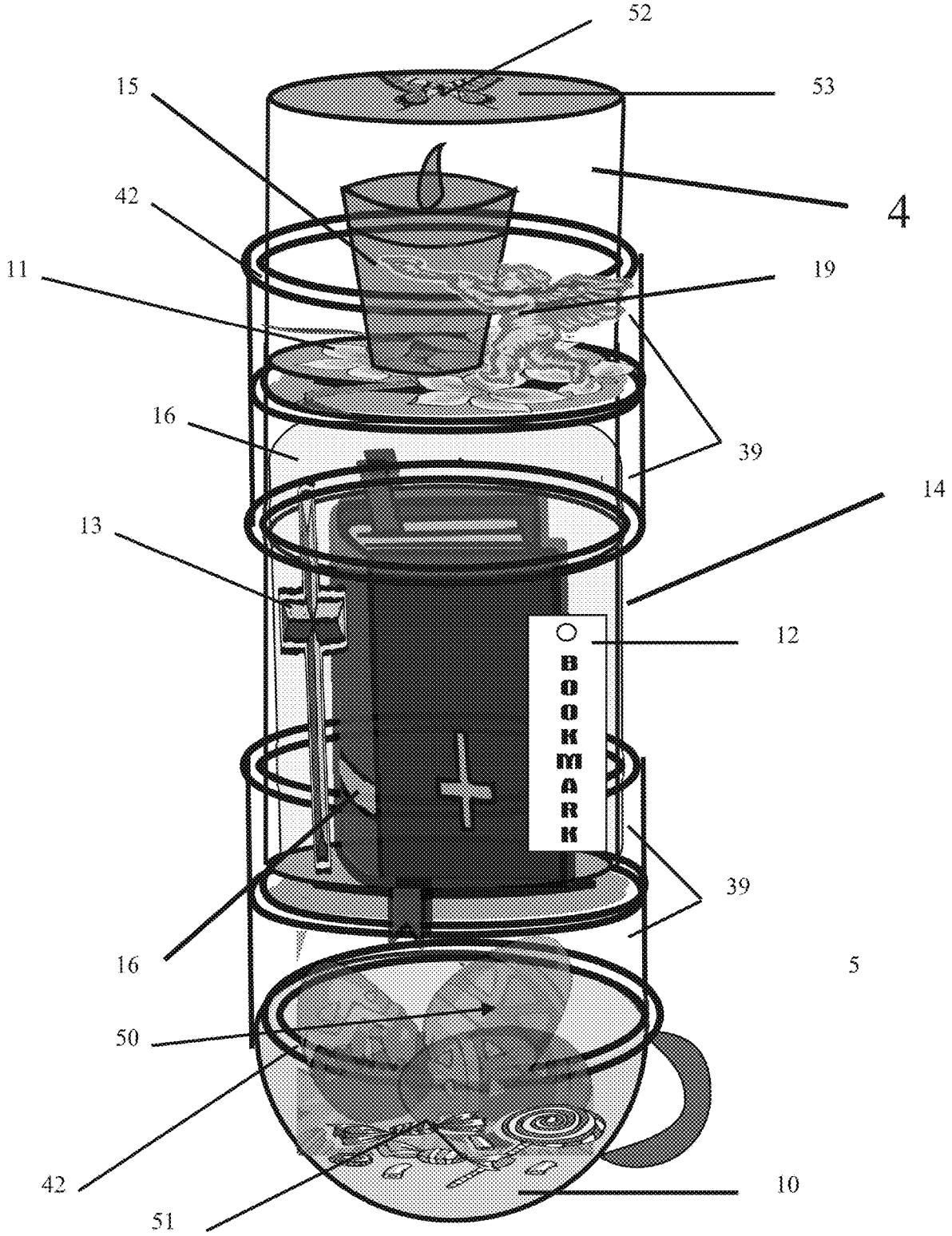

FIG. 10 is a perspective front-view of another product arrangement using larger compartment connectors to host a large mug and bible and photos. The compartment containers shown have threaded openings and bases for connection to each other and a larger host container with top and bottom threaded openings. This figure also shows the use of clear sheet material (14) inserted into the interior walls of the displayed host compartment cylinder for photo insertion. FIG. 12 is a perspective front-side view of a circle removable host container with four compartments.

Figure 11:
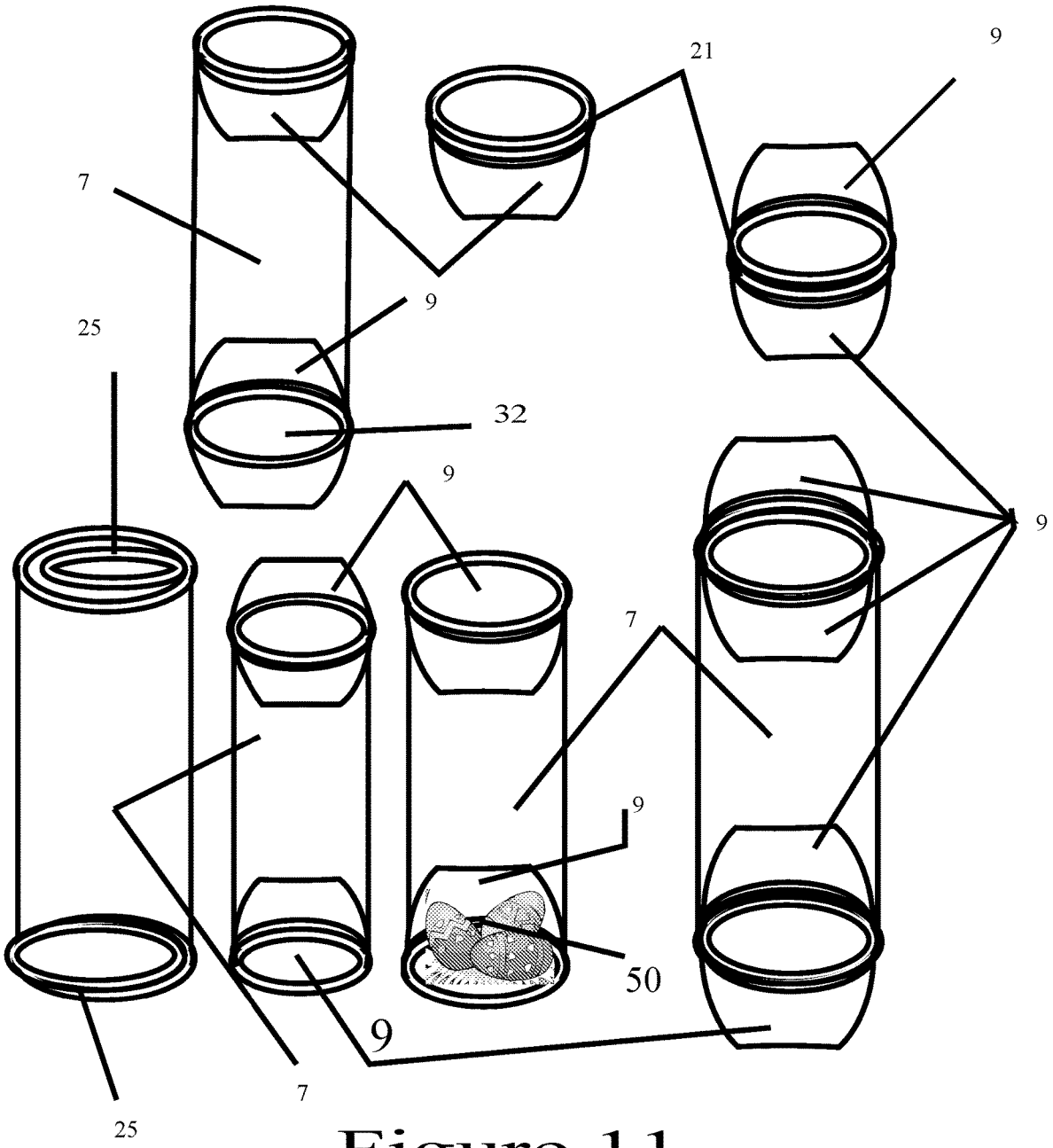

FIG. 11 is a perspective front-side view of a round/cylinder host container with exterior threaded openings and host compartment containers with closed bases and threaded openings. FIG. 11 also depicts varied assemblies using the container shown.

FIG. 12 is a reproduction of FIG. 10 with references and a butterfly on an upside down a clear host compartment container inserted into the upper cavity of the top compartment cavity with a butterfly for decoration at the top. Note that the arrangement of the present invention is this figure contains four compartment connector cavities (two joined sets) and a formed compartment container shells inserted into the interior walls of both connected compartment cavities for the additional display of literature and a bookmark. Also the bottom open edge of the compartment connector cavity is attached to the mug using the interior walls of the compartment connector cavity. This arrangement is representative of creativity how creative a user of the present invention can be to display multiple products in a display tower or arrangement.

Figure 13:
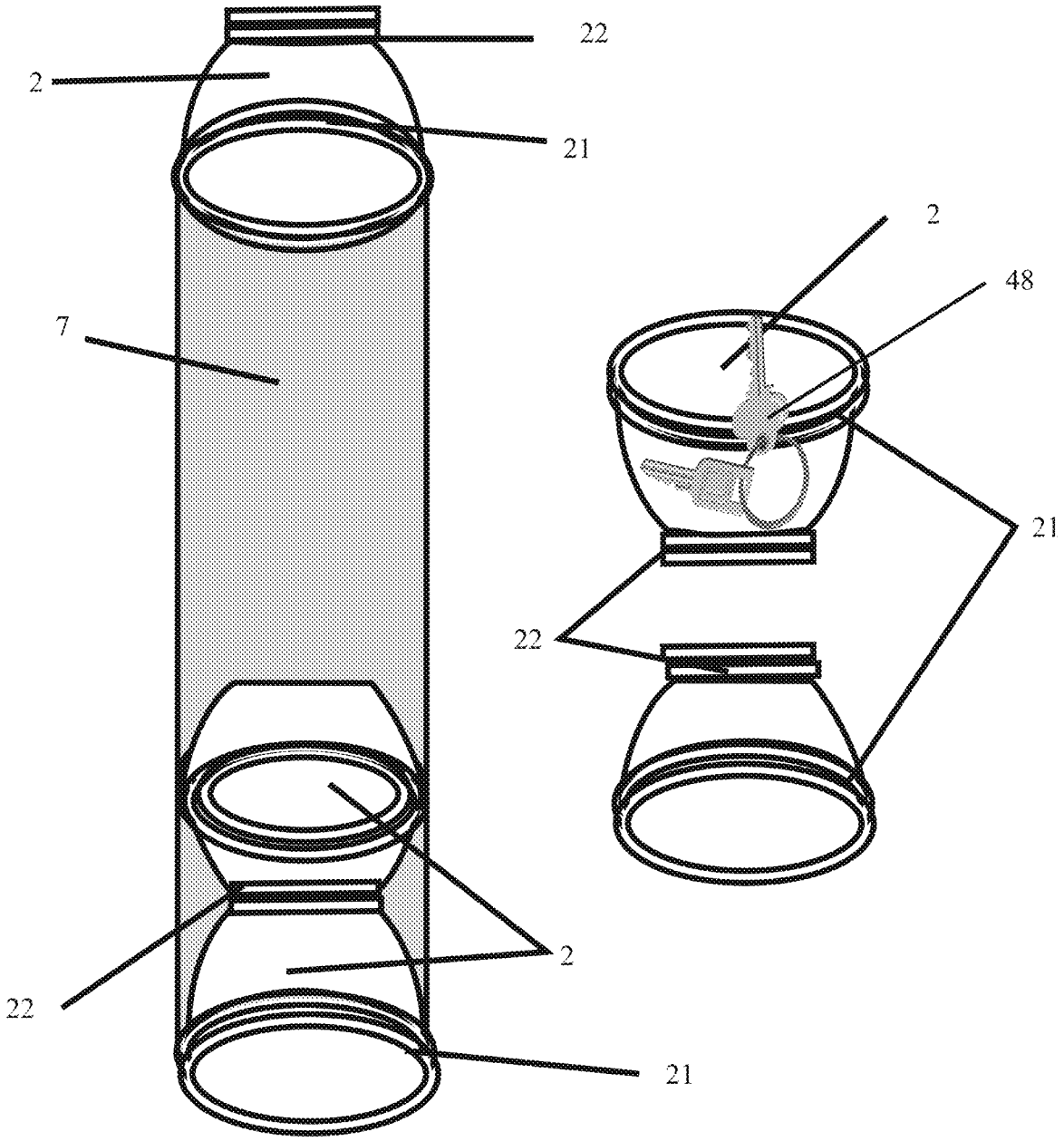

FIG. 13 is a perspective front-side view showing another arrangement of using screw-on compartment containers and a threaded cylinder at both openings of a host compartment container.

Figure 14:
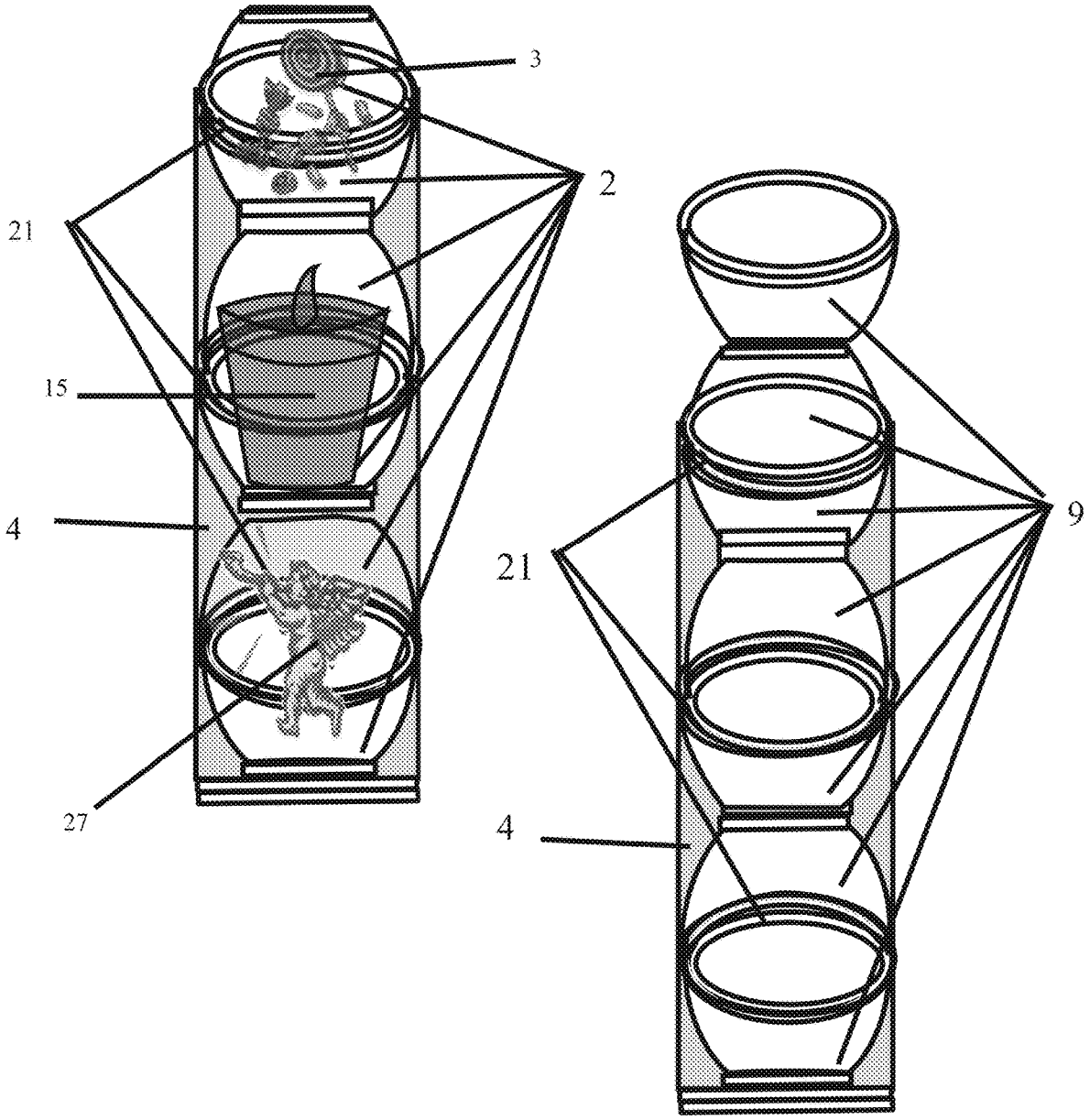

FIG. 14 is a perspective front-side view of another use of the present invention as referenced.

Figure 15:
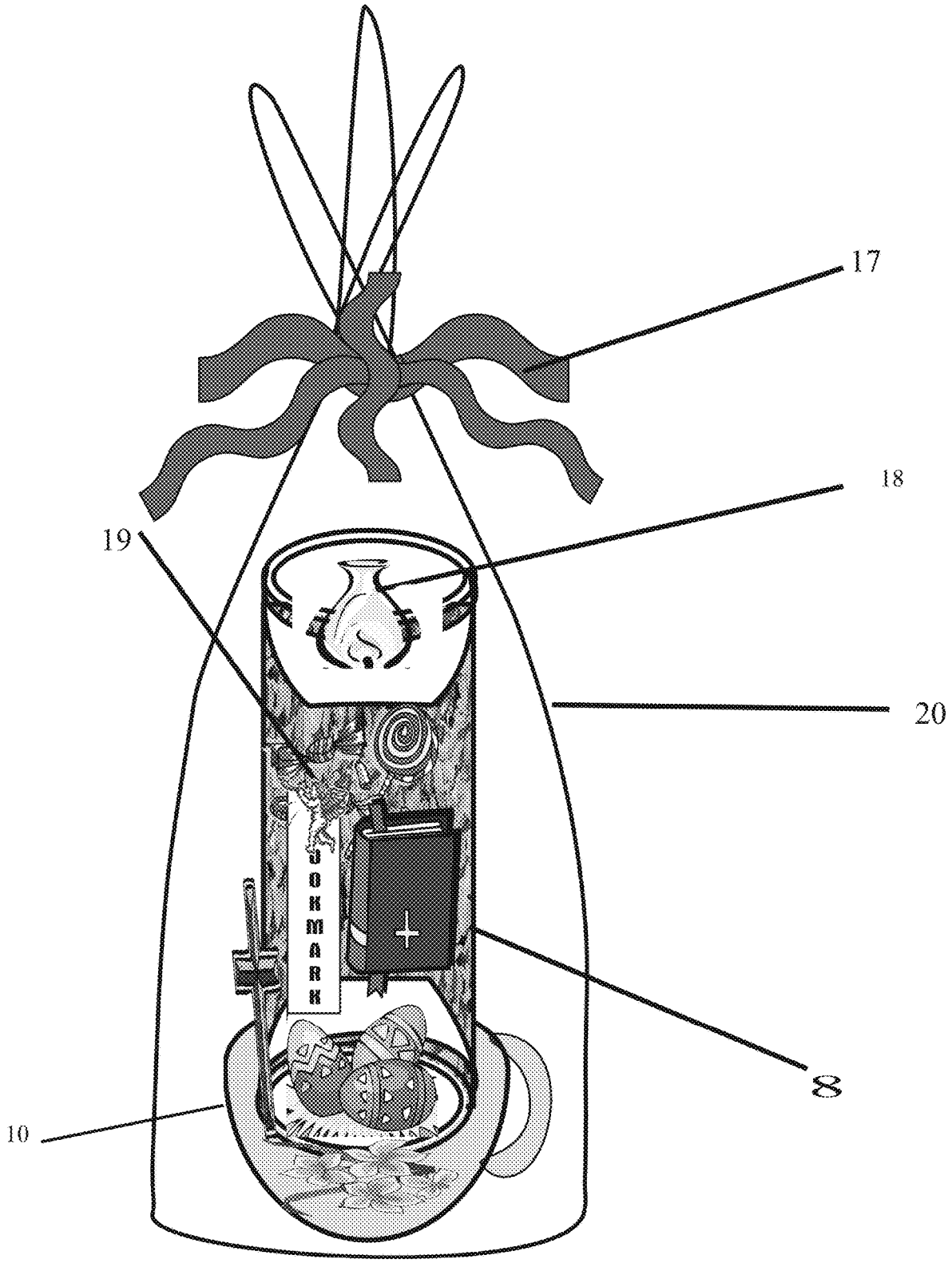

FIG. 15 is a perspective front-side view of use and packaging of the present invention using a different combination of compartment containers and formed sheet material.

Figure 16:
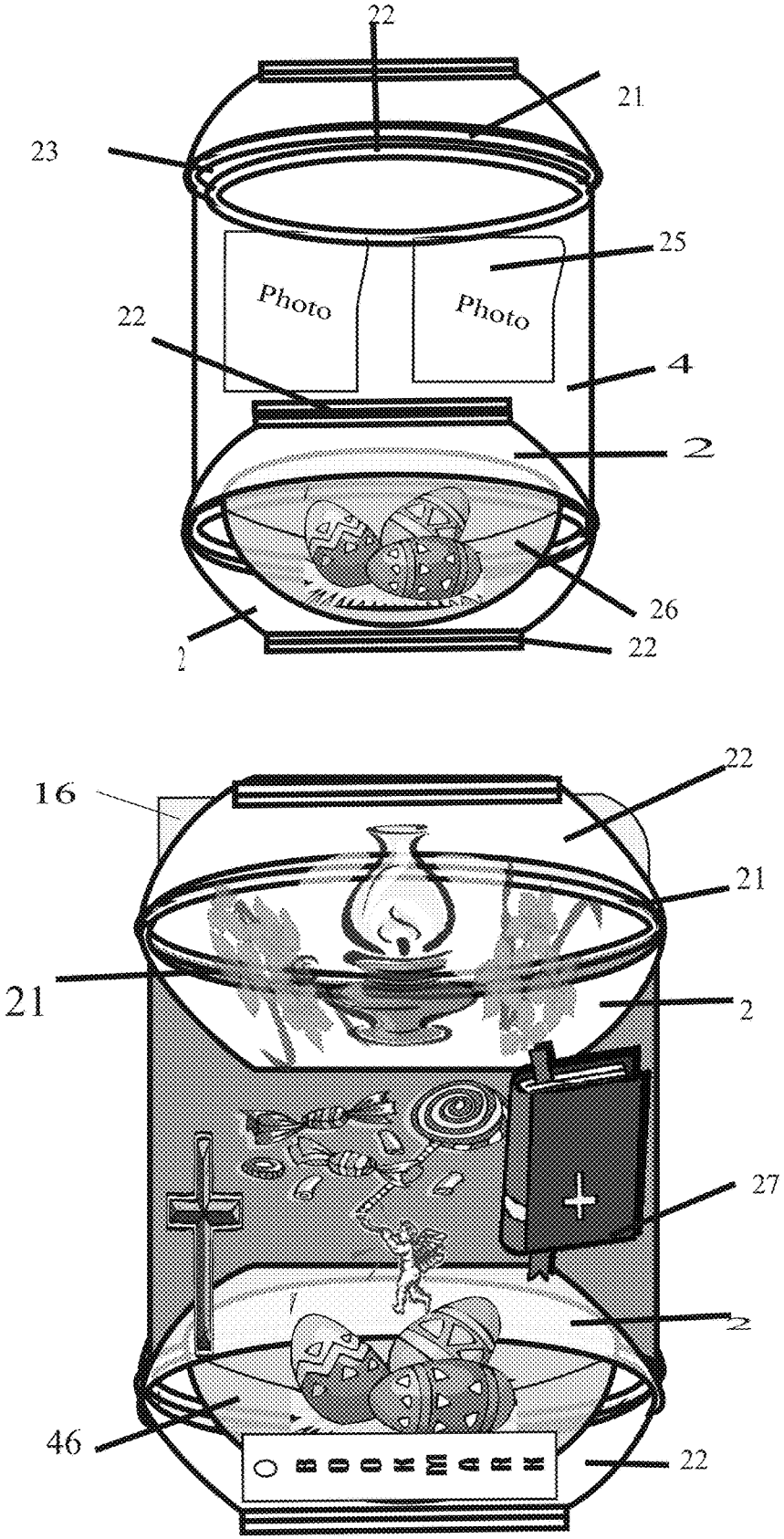

FIG. 16 is a perspective front-side view of the compartment containers with a bowl inside the bottom of the host container enclosed by two joined compartment containers to form a separate container and second joined compartment container at the top of the host container to form another removable compartment container. Each compartment container and the host container is filled with different gift items.

Figure 17:
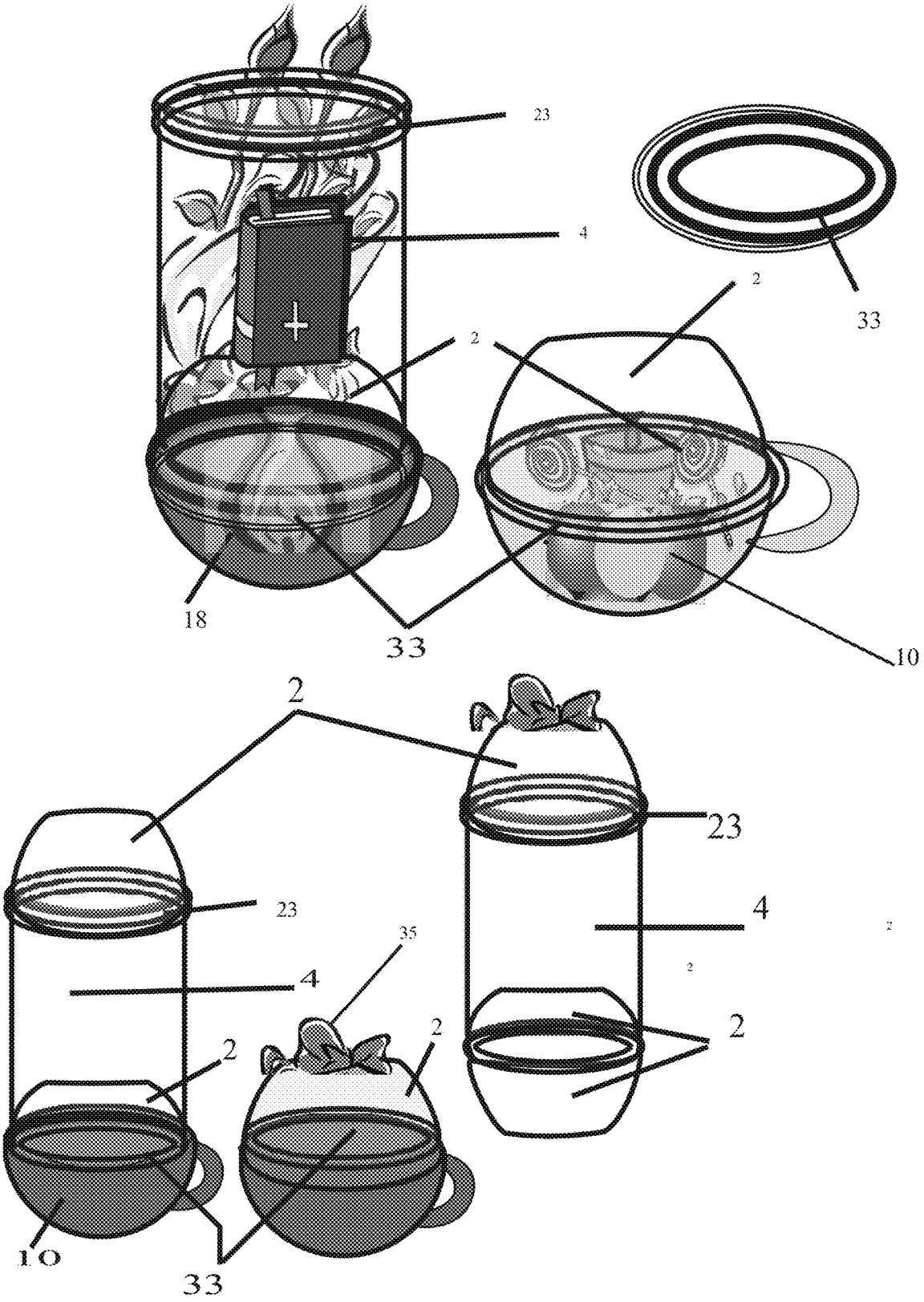

FIG. 17 is a perspective front-side view of yet another use of the present invention.

Figure 18:
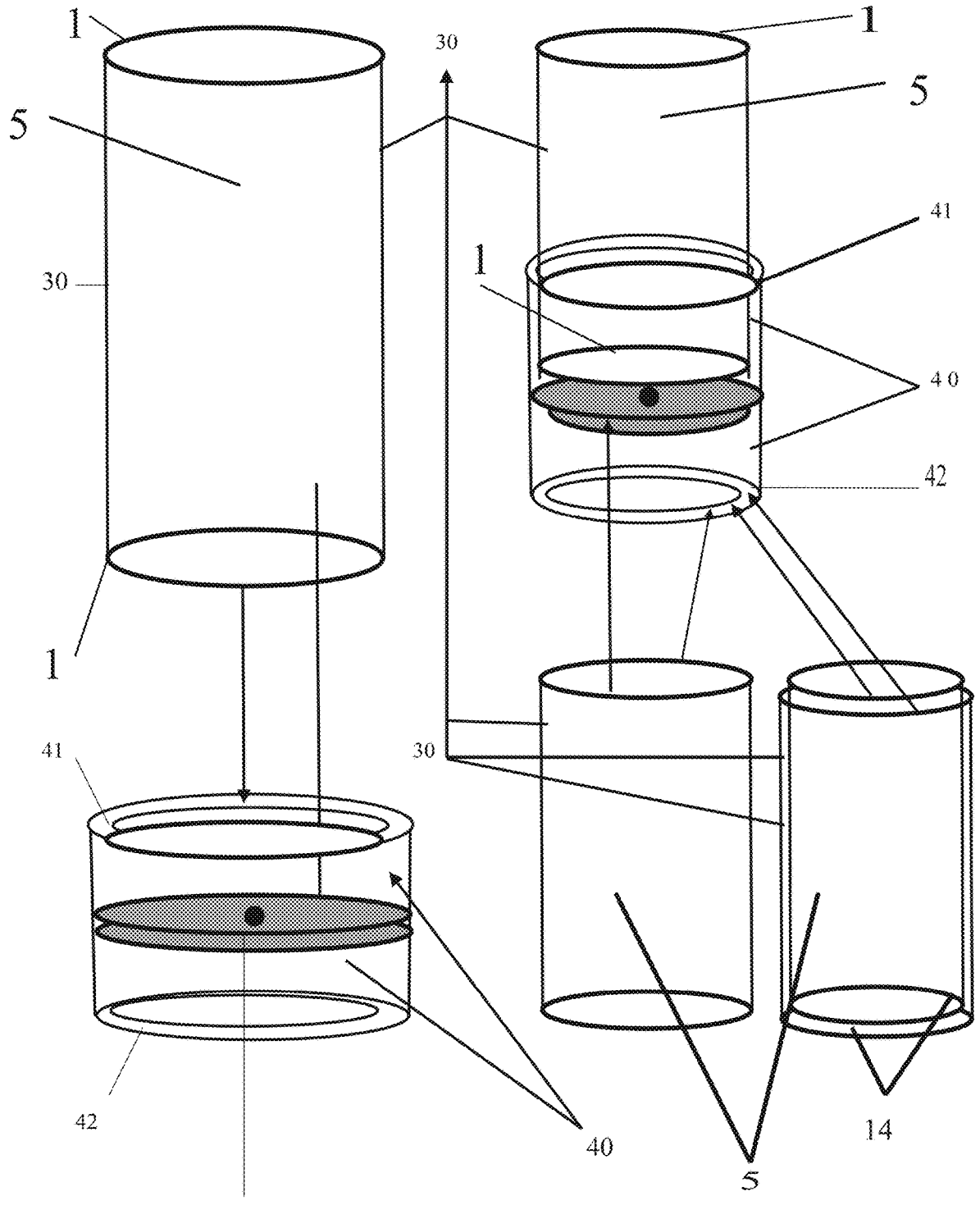

FIG. 18 is a perspective front-side view of how to assembly the invention for insertion of taller formed compartment material sheets for to display literature and other items.

Figure 19:
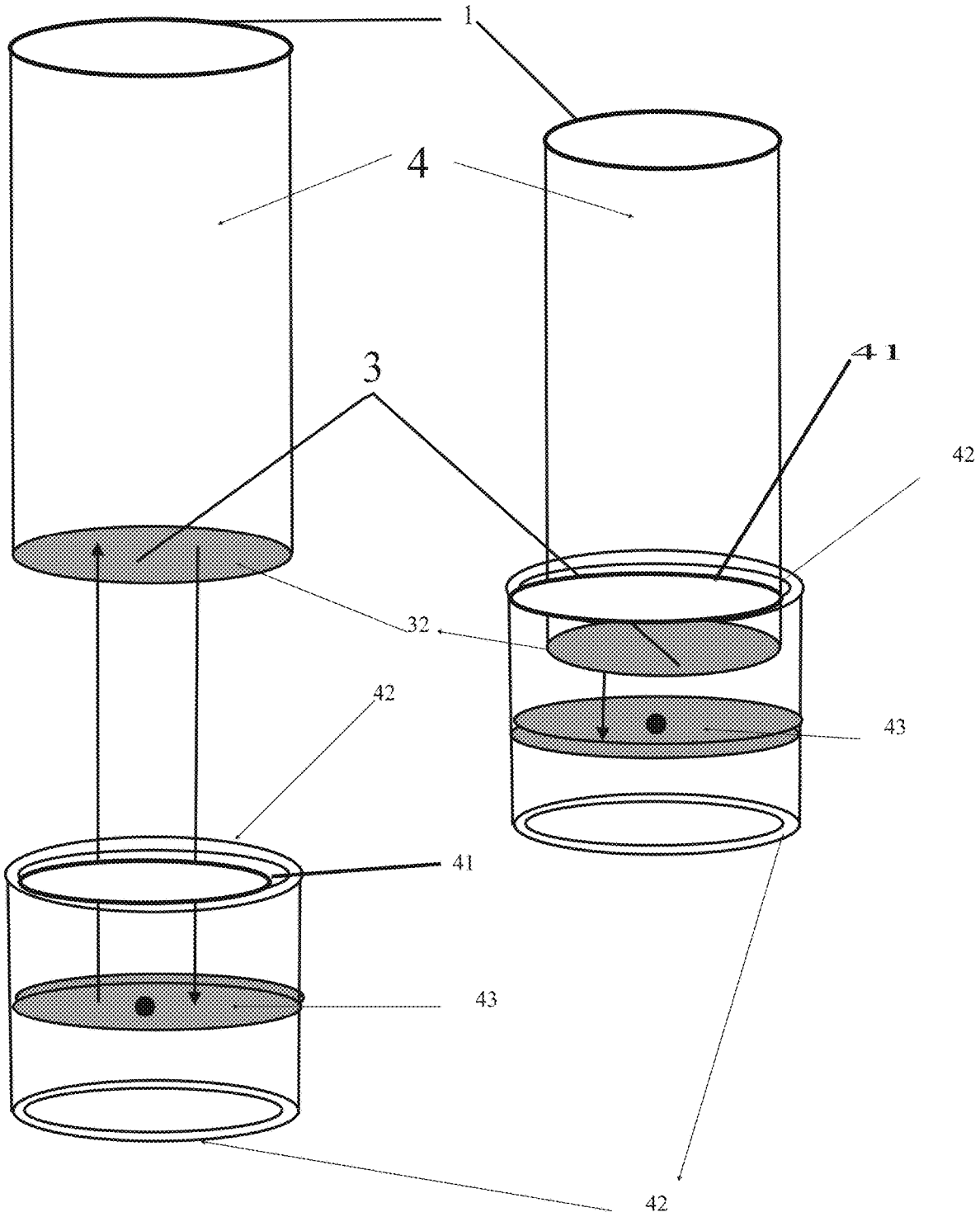

FIG. 19 is a perspective front-side view of a different assembly of the present invention.

Figure 20:
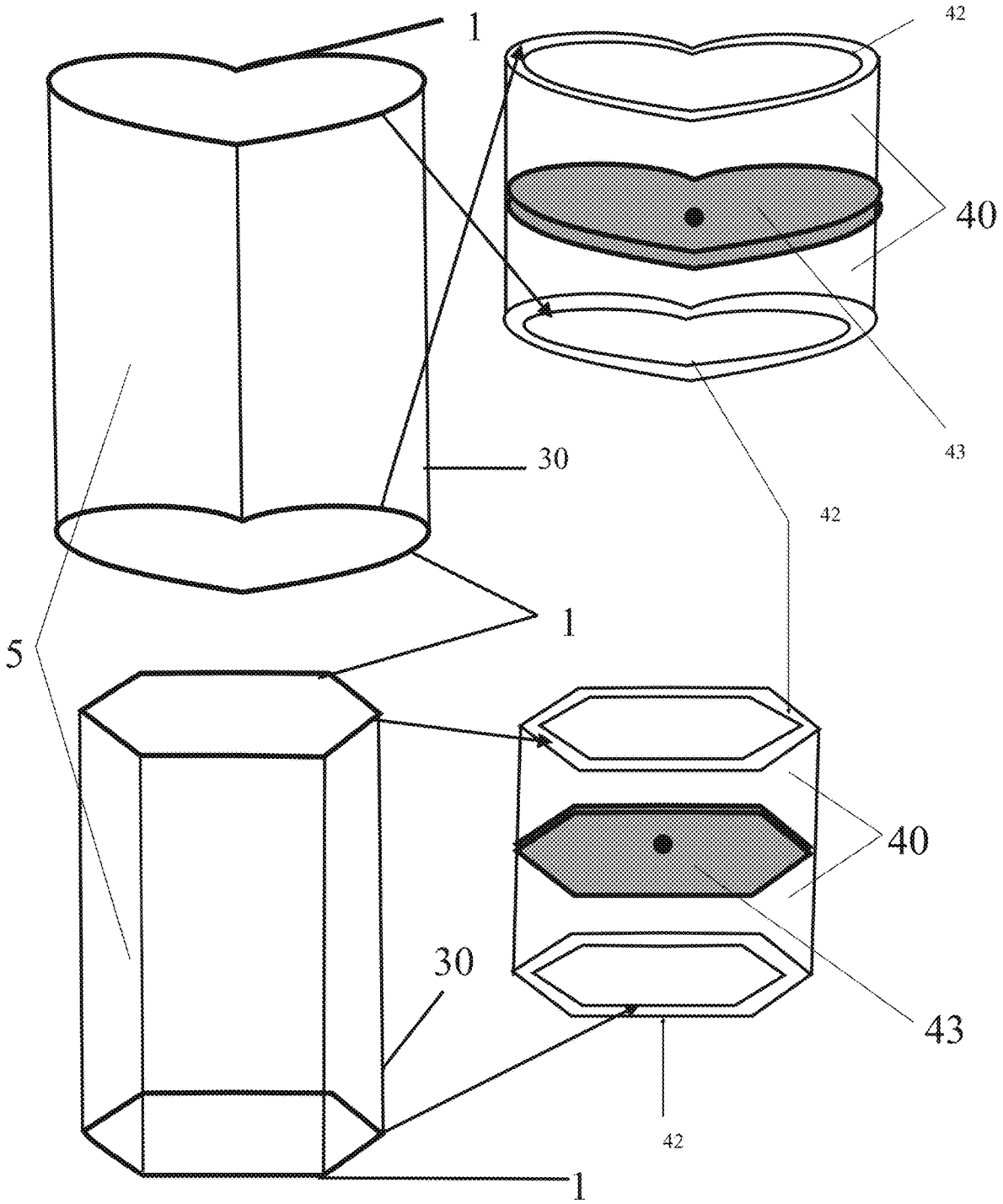

FIG. 20 is a perspective front-side view of how to assembly the invention for insertion of taller shaped formed compartment material sheets using shaped compartment connector cavities.

Figure 21:
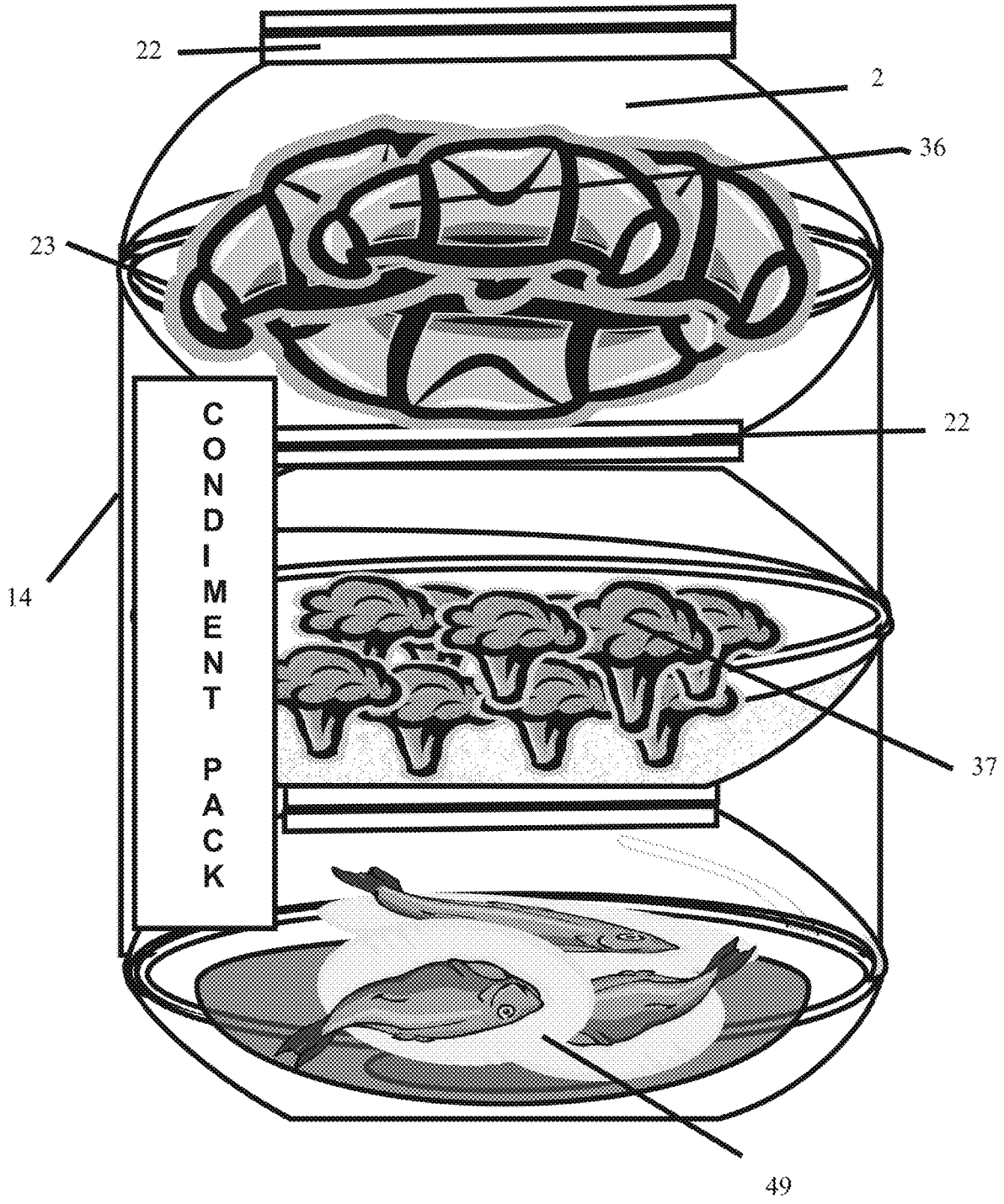

FIG. 21 is a perspective front-side view of a food product arrangement using the present invention.

Figure 22:
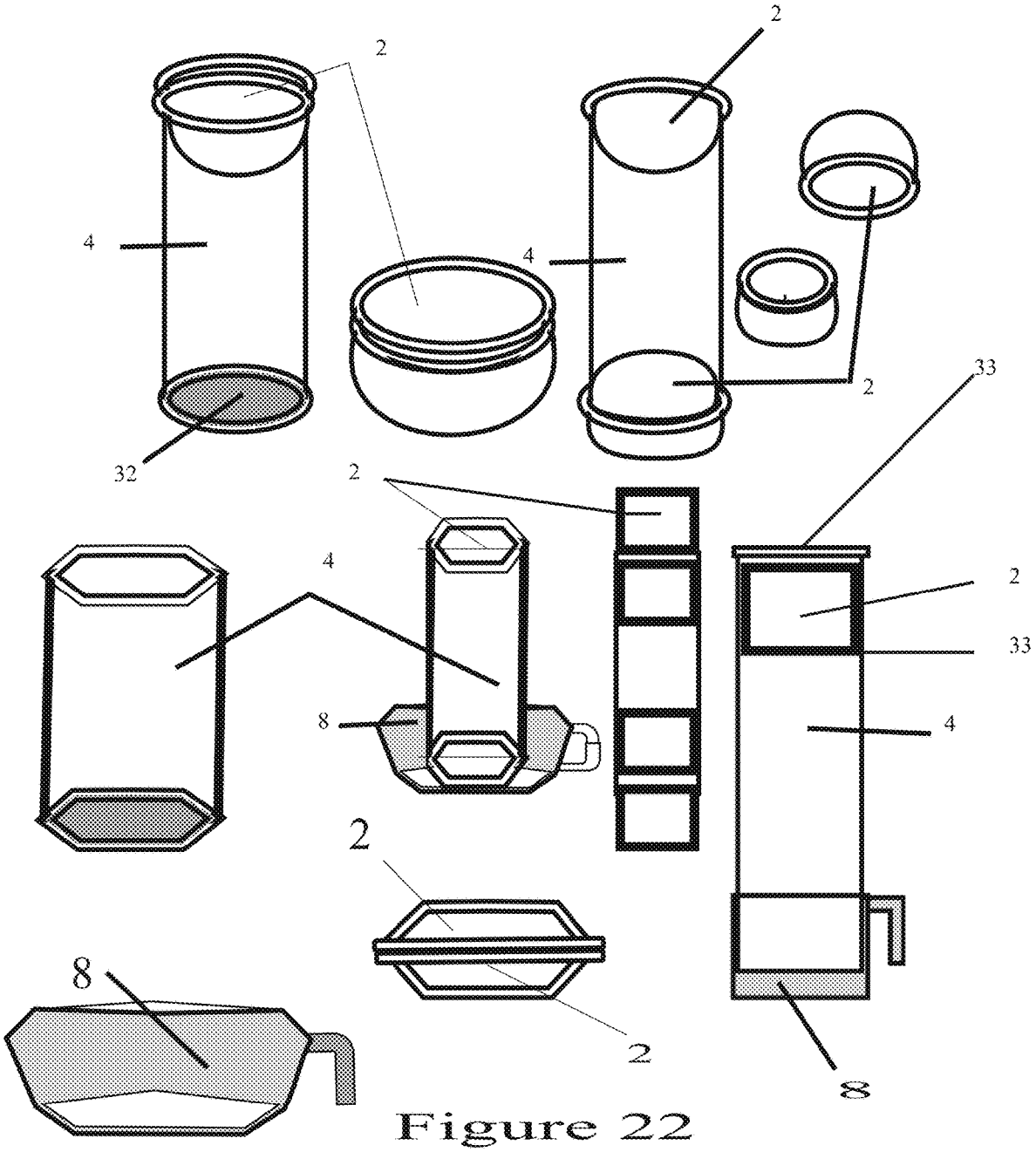

FIG. 22 is a perspective front-side view of how to several assembly alternatives and uses of the present invention.

Figure 23:
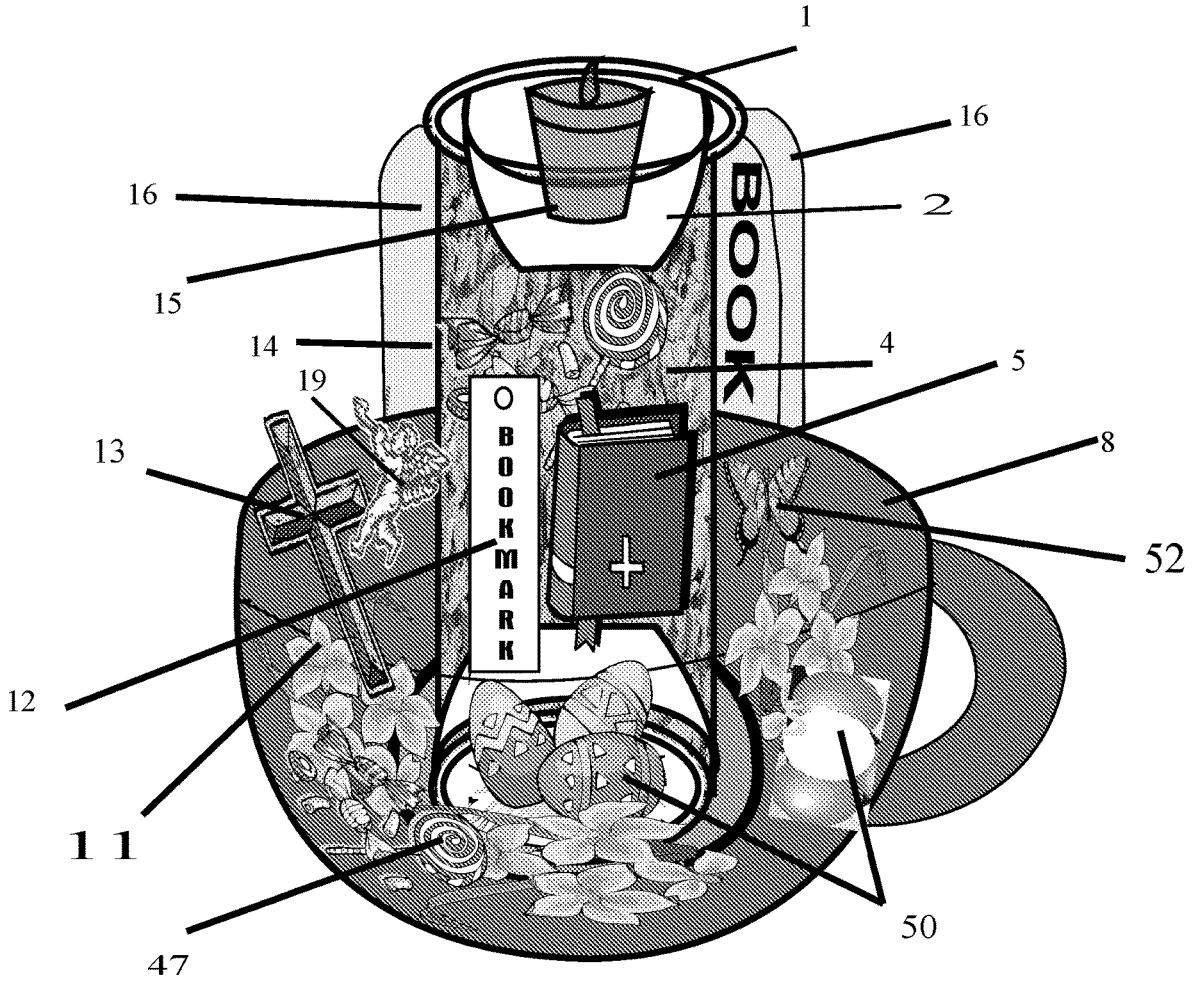

FIG. 23 is a perspective front-side view of yet another use of the present invention inserted into a mug with surrounding items.

Figure 24:
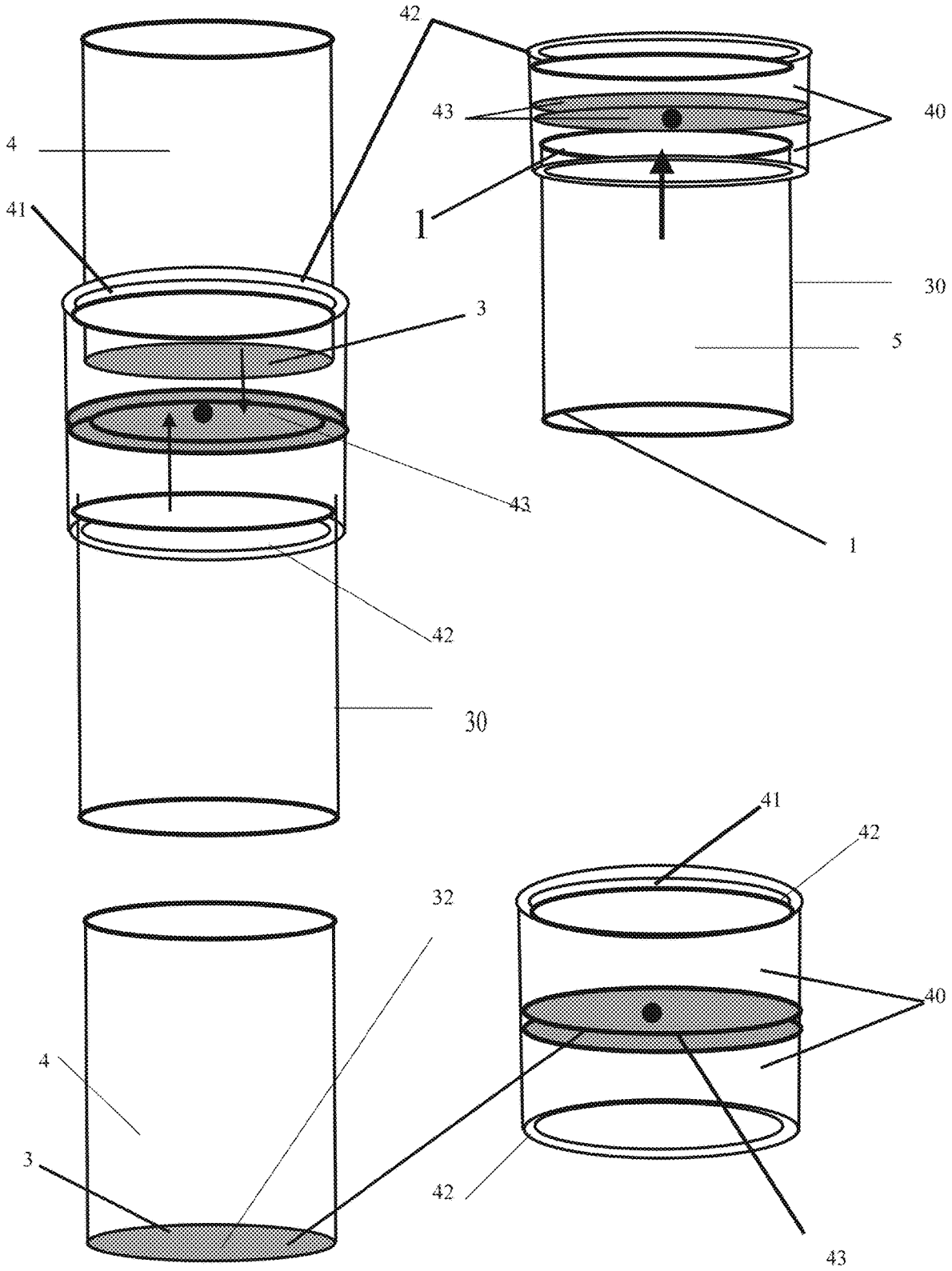

FIG. 24 is a perspective front-side view of another assembly and use of both a sealed bottom host container and a formed host container shell to add more product capacity using compartment connector cavities.

Figure 25:
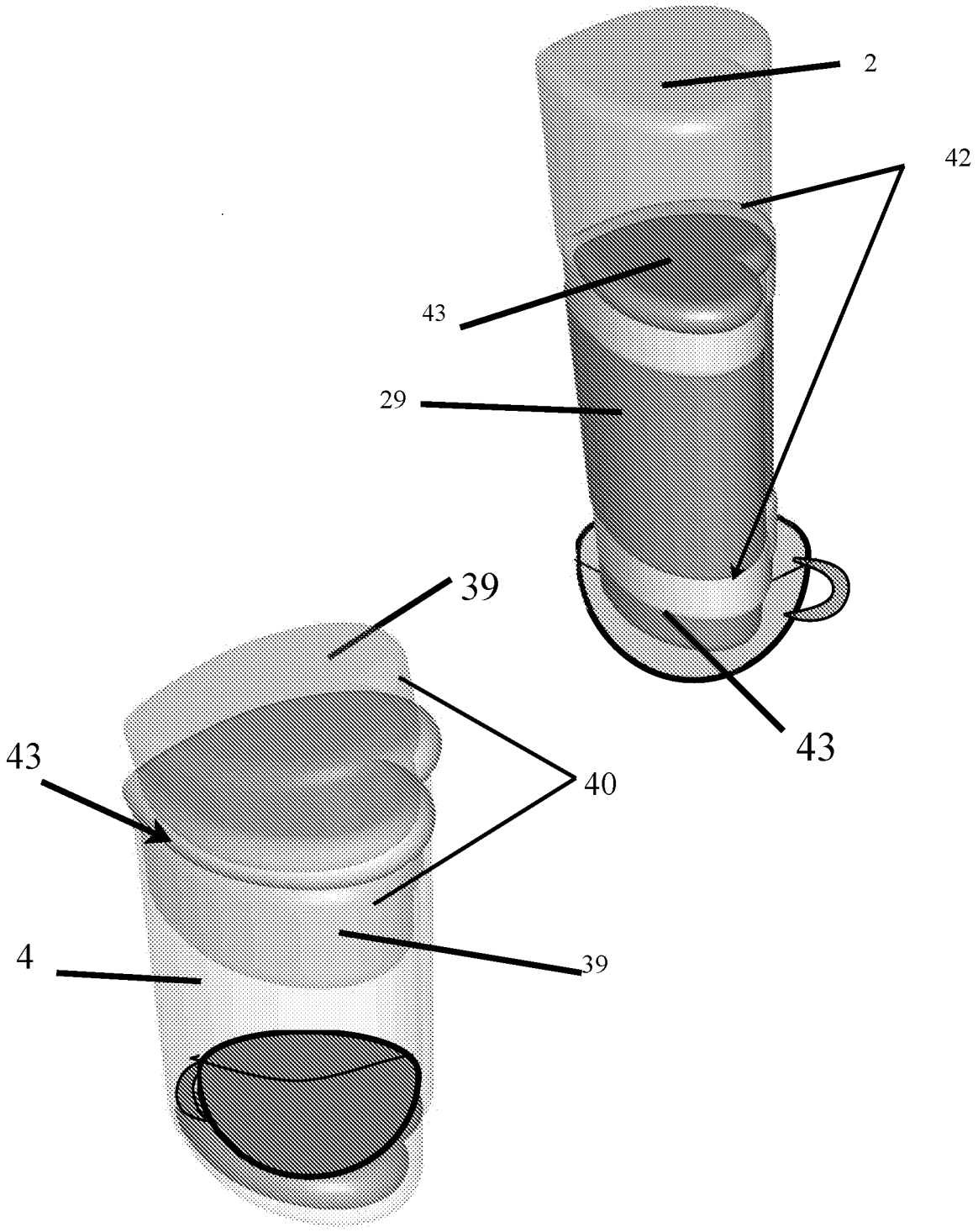

FIG. 25 is a perspective front-side view of yet another use of the present invention using shaped compartment containers and shaped compartment connector cavities in color and placeable into a mug and with a mug inside a larger assembly of the present invention.

Figure 26:
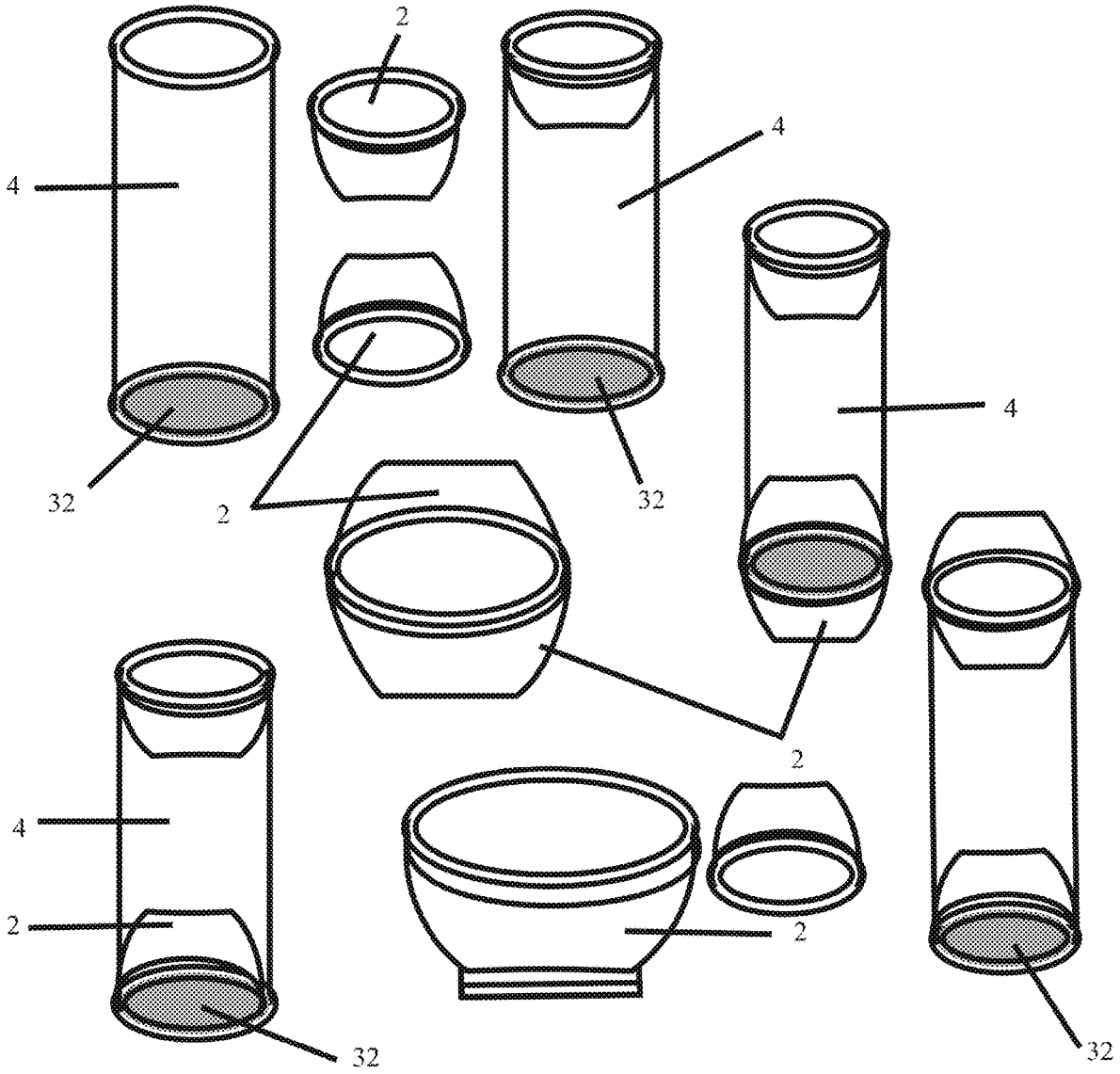

FIG. 26, is a perspective front-side view of yet another use of the present invention inserted into a mug with surrounding items.

Figure 27:
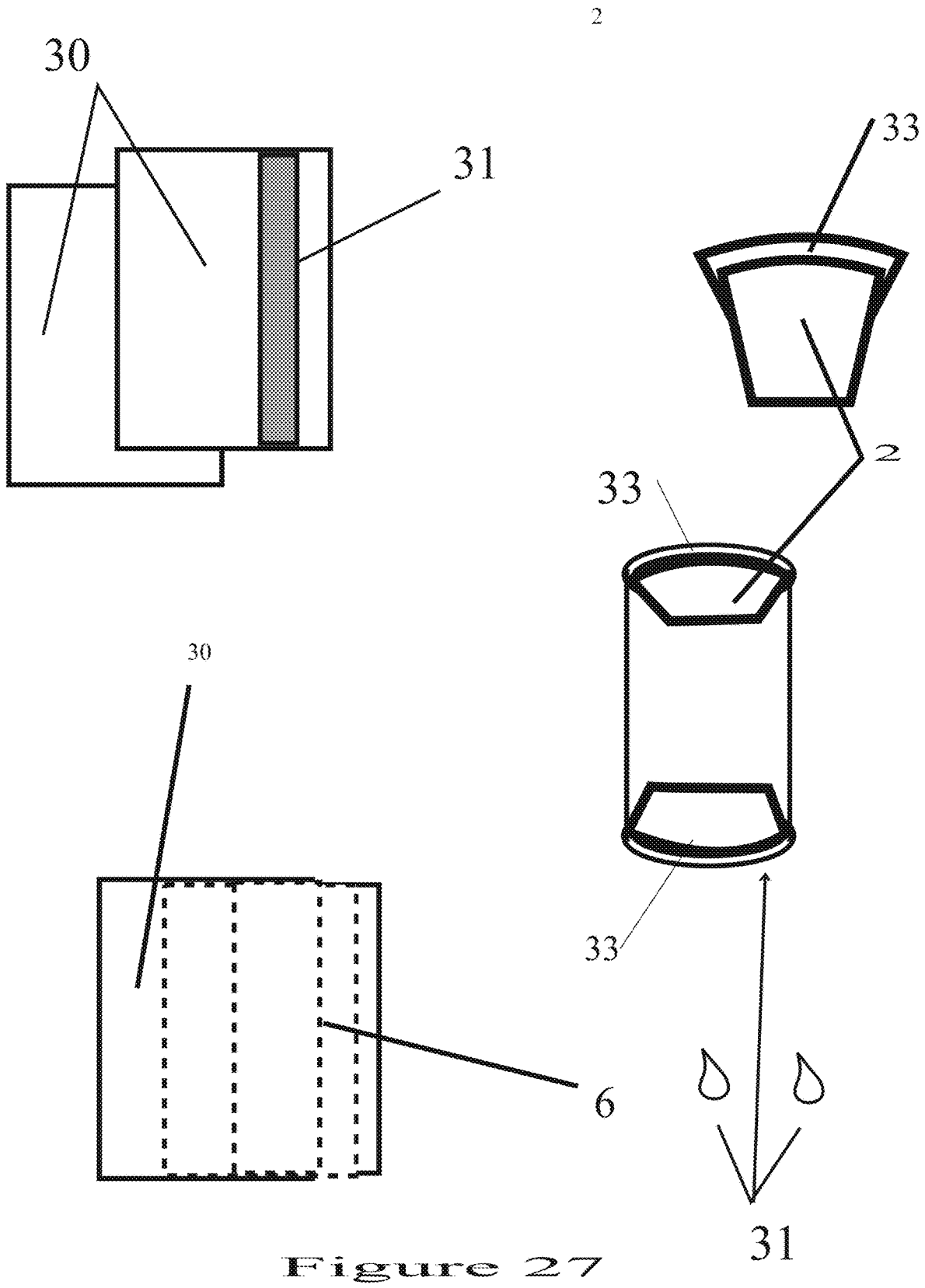

FIG. 27 is a perspective front-side view of yet another use of the present invention using sealed bottom shaped compartment containers wherein the base is attached using yet another type of shaped compartment containers using material sheets as described in the specification. Also shown is a preconfigured material sheet for use with the present invention and the use of adhesive to secure a formed material sheet to a folded lip, host compartment container at the base of a material sheet.

Figure 28:
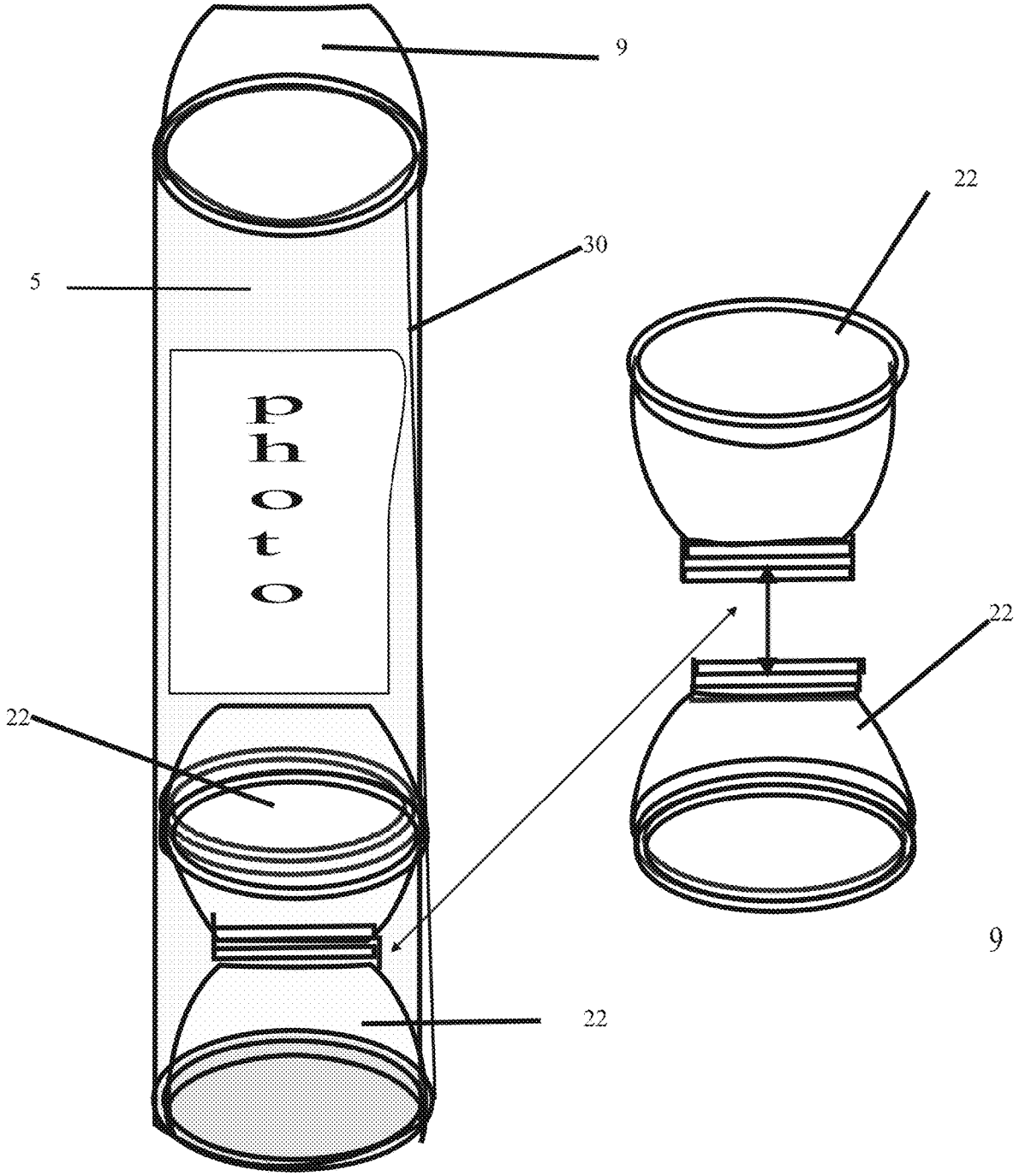

FIG. 28 is a perspective front-side view of yet another use of the present invention using referenced components.

REFERENCE MATERIALS

1 Edge of a shaped or formed host or compartment container
2 Shaped compartment container with folder lip
3 Secured base or bottom of a shaped host container
4 Shaped host container with secured base or bottom
5 Shaped formed material sheets
6 Folds in formed material sheet (5) for making a shaped host container
7 Shaped host container with a threaded edge
8 Open ended shaped host container shell using material sheets (5)
9 Shaped host compartment container bowl with screw on opening (male or female)
10 Mug
11 Flowers
12 Bookmark
13 Cross
14 Two formed shaped compartment container shells with one inside the other to create gap
15 Candle
16 Bible, Book, Journal, or Literature
17 Ribbon
18 Lantern
19 Angel figurine
20 Clear wrapping paper
21 Threaded edge of a shaped bowl compartment container
22 Round compartment container with screw-on base and screw on opening
23 Screw-on lip for large host container
24 Mug bowl
25 Threaded edge of a shaped host container
26 Threaded edge of a compartment connector cavity
27 Angel
28 Heart shaped host compartment container with mug inside
29 Heart shaped host compartment container, colored material
30 Clear flexible sheet material
31 Adhesive
32 Push-in base of a host compartment container (14)
33 Push-in fold over edge of a host compartment container (2)

34 Push-in male or female base of a non-screw compartment container (2)
35 Bow
36 Bread or Croissants inside two joined compartment containers
37 Broccoli in rice inside two joined compartment containers
38 Compartment connector cavity, threaded interior wall
39 Compartment connector cavity, unthreaded
40 Compartment connector cavities joined by interior screw
41 Threaded interior wall of a compartment connector cavity 38 and 39
42 Double wall of a compartment connector cavity with opening between walls
43 Base of compartment connector cavities 38 or 39
44 Screw hole
45 Screw
46 Bowl
47 Candy or Gum
48 Keys
49 Fish
50 Eggs
52 Butterfly
53 Clear Bottom of a shaped host container turned upside down

What is claimed:

1. A shaped host compartment container for packing multiple items into a single display container comprising:
a shaped host container,
said shaped host container having an opening and a sealed base;
said shaped host container having a top surface edge at its opening;
said shaped host container having its opening being either one of a threaded and a nonthreaded opening;
a shaped compartment container,
said shaped compartment container having a top and a bottom;
said shaped compartment container having a sealed base at the bottom and an opening at the top;
said shaped compartment container having a sealed base and either one of a screw-on and a push-in bottom surface extending from its sealed base;
said shaped compartment container having either one of a screw-on and a push-in top surface edge;
a shaped compartment container shell;
said shaped compartment container shell having a top surface edge and a bottom surface edge;
said shaped compartment container shell having open ends;
said shaped compartment container shell having an interior surface and an exterior surface;
said shaped compartment container shell having either one of
a threaded arrangement and a nonthreaded arrangement;
two shaped compartment connector cavities;
each said shaped compartment connector cavity having a top and a bottom;
each said shaped compartment connector cavity having a sealed base at its bottom and an opening at its top;
each said shaped compartment connector cavity having a first interior wall extending from its base to form a cavity and further;
each said shaped compartment connector cavity having a second exterior wall extending from its base;
said first interior wall having an inside surface and an outside surface;
said second exterior wall having an inside surface and an outside surface;
wherein said first interior wall outside surface faces said second exterior wall inside surface; wherein
said first interior wall and said second exterior wall form a gap between the outside surface of said first interior wall and the inside surface of said second exterior wall to form a double walled cavity;
each said shaped compartment connector cavity first interior wall surface and second exterior wall surface are either one of
a threaded and a nonthreaded surface;
each said shaped compartment connector cavity sealed base has either one of
a threaded hole and a nonthreaded hole at the center of its base, whereby two compartment connector cavities are joined using any one of
adhesive, a screw and a plug;
a shaped material sheet;
said shaped material sheet having a top surface edge and a bottom surface edge;
said shaped material sheet having a right surface edge and a left surface edge, whereby
joining said right surface edge and said left surface edge form the shape of the shaped material sheet;
said shaped material sheet is insertable at either one of its top surface edge and its bottom surface edge into any one of
the shaped host container,
the shaped compartment container,
one of the shaped compartment connector cavity,
the shaped compartment container shell, and
the second shaped material sheet; and
whereby said shaped material sheet is placed inside said shaped material sheet to form a gap between the two shaped material sheets;
said gap between the two shaped material sheets forms an opening for insertion of either one of
a shaped compartment container and one shaped compartment connector cavity;
a host vessel;
said host vessel having a top and a bottom;
said host vessel having an upper surface wall opening;
said host vessel upper surface wall opening has an outer surface edge;
said host vessel having an interior compartment area within its wall opening;
said outer surface edge of said host vessel upper surface wall opening is insertable into the gap of the first interior wall and the second exterior wall of one said shaped compartment connector cavity;
wherein said shaped host compartment container for packing multiple items into a single container is achieved by connecting said shaped host container, said shaped compartment container, said shaped compartment container shell, said shaped compartment connector cavities, said shaped material sheet, and said shaped host vessel.

2. A shaped host compartment container for packing multiple items into a single container as claimed in claim 1, and further wherein said shaped host container, said shaped compartment container, said shaped compartment container shell, said shaped compartment connector cavities, and said shaped material sheet are each in the shape of any one of round, oval, rectangle, polygon, heart, square, cross, jewel, star and triangle.

3. A shaped host compartment container for packing multiple items into a single container as claimed in claim 1, and further wherein said shaped host container, said shaped compartment container, said shaped compartment container shell, said shaped compartment connector cavities, and said shaped material sheets are constructed from shapeable material.

4. A shaped host compartment container for packing multiple items into a single container as claimed in claim 1, and further, wherein said shaped compartment container is in the shape of any one of a bowl, a cup and a cavity, and wherein said bowl, cup and cavity are in the shape of any one of round, oval, rectangle, polygon, heart, square, cross, jewel, star and triangle.

5. A shaped host compartment container as claimed in claim 4 and further wherein said shaped compartment container has either one of a screw-on and a push-in top surface edge;

wherein said push-in top surface edge comprises a folded lip; whereby said folded lip is sandwiched between any one of the bottom surface edge of said shaped compartment container shell;

the top surface edge of said shaped compartment container shell;

the top surface edge of said shaped material sheet;

the bottom surface edge of said shaped material sheet;

the gap between said two shaped material sheets;

the gap between the first interior wall and the second exterior wall of one said compartment connector cavity; and the upper surface wall opening of said host vessel.

6. A shaped host compartment container as claimed in claim 4 and further wherein said shaped compartment container has either one of a screw-on and a push-in bottom surface edge.

7. A shaped host compartment container as claimed in claim 1 and further wherein each said shaped compartment connector cavity comprises said first interior wall and said second exterior wall forming said gap for insertion of any one or more of said shaped compartment container;

said shaped material sheet;

said shaped host vessel; and said shaped compartment container shell.

8. A shaped host compartment container for packing multiple items into a single container as claimed in claim 1, wherein said shaped host vessel is any one of a mug, cup, box, pail, basket, bucket, bowl, and a vase.

9. A method of making the shaped host compartment container of claim 1 for packing multiple items into a single product display container comprises the steps of connecting said shaped host container;

said shaped compartment container;

said shaped compartment connector cavities;

said shaped material sheet;

said shaped compartment container shell; and said host vessel.

* * * * *